US005746887A

United States Patent [19]

Wendt et al.

[11] Patent Number: 5,746,887

[45] Date of Patent: May 5, 1998

[54] METHOD OF MAKING SOFT TISSUE PRODUCTS

[75] Inventors: Greg Arthur Wendt, Neenah, Wis.; Kai F. Chiu, Brandon, Miss.; Mark Alan Burazin; Theodore Edwin Farrington, Jr., both of Appleton, Wis.; David Alan Heaton, Woodstock, Ga.

[73] Assignee: Kimberly-Clark Worldwide, Inc., Neenah, Wis.

[21] Appl. No.: 637,141

[22] Filed: Apr. 24, 1996

Related U.S. Application Data

[60] Division of Ser. No. 384,304, Feb. 6, 1995, Pat. No. 5,672,248, which is a continuation-in-part of Ser. No. 226,630, Apr. 12, 1994, abandoned.

[51] Int. Cl.[6] ..... D21F 11/00

[52] U.S. Cl. ..... 162/109; 162/111; 162/113; 162/117; 162/123; 162/127; 162/129

[58] Field of Search ..... 162/109, 111, 162/113, 117, 123, 9, 127, 129

[56] References Cited

U.S. PATENT DOCUMENTS

| | | | |
|---|---|---|---|
| 3,301,746 | 1/1967 | Sanford et al. | 162/117 |
| 3,556,932 | 1/1971 | Coscia et al. | 162/166 |
| 3,556,933 | 1/1971 | Williams et al. | 162/167 |
| 3,700,623 | 10/1972 | Keim et al. | 260/80.3 R |
| 3,772,076 | 11/1973 | Keim | 117/155 R |
| 3,855,158 | 12/1974 | Petrovich et al. | 162/164 |
| 3,899,388 | 8/1975 | Petrovich et al. | 162/164 |
| 3,974,025 | 8/1976 | Ayers | 162/113 |
| 3,994,771 | 11/1976 | Morgan, Jr. et al. | 162/113 |
| 4,129,528 | 12/1978 | Petrovich et al. | 260/823 |
| 4,147,586 | 4/1979 | Petrovich et al. | 162/135 |
| 4,191,609 | 3/1980 | Trokhan | 162/113 |
| 4,222,921 | 9/1980 | Van Eenam | 260/29.6 H |
| 4,225,382 | 9/1980 | Kearney et al. | 162/111 |
| 4,239,065 | 12/1980 | Trokhan | 139/383 |
| 4,440,597 | 4/1984 | Wells et al. | 162/111 |
| 4,514,345 | 4/1985 | Johnson et al. | 264/22 |
| 4,529,480 | 7/1985 | Trokhan | 162/109 |
| 4,675,394 | 6/1987 | Solarek et al. | 536/43 |
| 4,942,077 | 7/1990 | Wendt et al. | 162/113 |
| 4,981,557 | 1/1991 | Bjorkquist | 162/168.2 |
| 5,008,344 | 4/1991 | Bjorkquist | 525/328.2 |
| 5,048,589 | 9/1991 | Cook et al. | 162/109 |
| 5,085,736 | 2/1992 | Bjorkquist | 162/168.2 |
| 5,129,988 | 7/1992 | Farrington, Jr. | 162/123 |
| 5,348,620 | 9/1994 | Hermans et al. | 162/9 |
| 5,399,412 | 3/1995 | Sudall et al. | 428/153 |
| 5,429,686 | 7/1995 | Chiu et al. | 139/383 A |
| 5,501,768 | 3/1996 | Hermans et al. | 162/9 |

FOREIGN PATENT DOCUMENTS

| | | | |
|---|---|---|---|
| 2069193 | 12/1992 | Canada . | |
| 0109307 | 5/1984 | European Pat. Off. | D21F 11/00 |
| 0 342 646 | 11/1989 | European Pat. Off. | D21F 11/14 |
| 0604824 | 7/1994 | European Pat. Off. | D21F 11/00 |
| 24 27 291 | 1/1975 | Germany | D21H 5/02 |
| 185197 | 8/1991 | Japan . | |
| 1389992 | 4/1975 | United Kingdom | D21F 9/00 |
| 2001370 | 1/1979 | United Kingdom | D21F 5/18 |
| 2279372 | 1/1995 | United Kingdom | D21F 11/14 |
| WO9300474 | 1/1993 | WIPO . | |
| WO9300475 | 1/1993 | WIPO . | |

OTHER PUBLICATIONS

Ashley, Steven, "Rapid Protyping Systems", *Mechanical Engineering*, Apr. 1991, pp. 34–43.

*Primary Examiner*—Peter Chin
*Attorney, Agent, or Firm*—Gregory E. Croft

[57] ABSTRACT

Throughdried tissue products such as facial tissue, bath tissue, and paper towels are made using a throughdrying fabric having from about 5 to about 300 machine direction impression knuckles per square inch (per 6.45 square centimeters) which are raised above the plane of the fabric. These impression knuckles create corresponding protrusions in the throughdried sheet which impart a significant amount of cross-machine direction stretch to the sheet. In addition, other properties such as bulk, absorbent capacity, absorbent rate and flexibility are also improved.

40 Claims, 16 Drawing Sheets

METHOD OF MAKING SOFT TISSUE PRODUCTS

This application is a divisional of application Ser. No. 08/384,304 entitled "METHOD FOR MAKING SOFT TISSUE PRODUCTS" and filed in the U.S. Patent and Trademark Office on Feb. 6, 1995 now U.S. Pat. No. 5,672,248, which is a continuation-in-part of application Ser. No. 08/226,630 filed on Apr. 12,1994, now abandoned. The entirety of this application is hereby incorporated by reference.

BACKGROUND OF THE INVENTION

In the manufacture of throughdried tissue products, such as facial and bath tissue and paper towels, there is always a need to improve the properties of the final product. While improving softness always draws much attention, the amount of stretch in the sheet is also important, particularly in regard to the perceived durability and toughness of the product. As the stretch increases, the tissue sheet can absorb tensile stresses more readily without rupturing. In addition, increased stretch, especially in the cross-machine direction, improves sheet flexibility, which directly affects sheet softness.

Through creping, improved sheet flexibility and machine direction stretch at levels of about 15 percent are easily attained, but the resulting cross-machine direction stretch is generally limited to levels of about 8 percent or less due to the nature of the tissuemaking process.

Hence there is a need for a method of increasing the flexibility and the cross-machine direction stretch of throughdried tissue products while maintaining or improving other desirable tissue properties.

SUMMARY OF THE INVENTION

It has now been discovered that certain throughdrying fabrics can impart significantly increased cross-machine direction (CD) stretch to the resulting tissue product, while at the same time also delivering high bulk, increased flexibility, a fast wicking rate, and a high absorbent capacity. These fabrics are characterized by a multiplicity of "impression knuckles" which are defined for purposes herein as being fabric knuckles which are elongated in the machine direction (MD) of the tissuemaking process, which are raised significantly above of the plane of the drying fabric, and which appear to overlap when the fabrics are viewed in the cross-machine direction. These impression knuckles impart corresponding protrusions in the tissue sheet as it is dried on the fabric. The height, orientation, and arrangement of the resulting protrusions in the sheet provide increased bulk, increased cross-machine direction stretch, increased flexibility, increased absorbent capacity and increased wicking rates. All of these properties are desirable for products such as facial tissue, bath tissue and paper towels or the like, herein collectively referred to as tissue products. The tissue sheets made in accordance with this invention can be used for one-ply or multiple-ply tissue products.

Surprisingly, it has also been discovered that the combination of uncreped throughdrying with high bulk fabrics and temporary wet strength chemistry results in soft tissue products with superior physical properties when partially saturated. Specific properties include Wet Compressed Bulk or WCB (hereinafter defined and expressed in cc/gm), Loading Energy Ratio or LER (hereinafter defined and expressed as %) and Wet Springback or WS (hereinafter defined and expressed as %). Tissues made by this invention are unique in their ability to achieve high values for all three of these tests simultaneously. These superior properties are achieved because the tissue's wet strength is established on the throughdrier fabric, while the sheet is in its desired three-dimensional configuration. The elimination of subsequent destructive creping ensures that the high bulk structure established on the throughdriers remains permanently, even after partial saturation has occurred. Tissues made by this invention exhibit superior integrity during use and are particularly well suited for the incorporation of various aqueous and nonaqueous-based chemical additives as post-treatments to further improve performance and functionality.

Hence in one aspect, the invention resides in a method of making a tissue sheet comprising: (a) depositing an aqueous suspension of papermaking fibers having a consistency of about 1 percent or less onto a forming fabric to form a wet web; (b) dewatering the wet web to a consistency of from about 20 to about 30 percent; (c) transferring the dewatered web from the forming fabric to a transfer fabric traveling at a speed of from about 10 to about 80 percent slower than the forming fabric; (d) transferring the web to a throughdrying fabric having from about 5 to about 300 impression knuckles per square inch (per 6.45 square centimeters), more specifically from about 10 to about 150 impression knuckles per square inch, and still more specifically from about 25 to about 75 impression knuckles per square inch, which are raised at least about 0.005 inch (0.012 centimeters) above the plane of the fabric, wherein the web is macroscopically rearranged to conform to the surface of the throughdrying fabric; and (e) throughdrying the web. The dried web can be creped or remain uncreped. In addition, the resulting web can be calendered.

In another aspect, the invention resides in a throughdried tissue sheet, creped or uncreped, having a basis weight of from about 10 to about 70 grams per square meter and from about 5 to about 300 protrusions per square inch (per 6.45 square centimeters), more specifically from about 10 to about 150 protrusions per square inch, and still more specifically from about 25 to about 75 protrusions per square inch, corresponding to impression knuckles on the throughdrying fabric, said tissue sheet having a cross-machine direction stretch of about 9 percent or greater, more specifically from about 10 to about 25 percent, and still more specifically from about 10 to about 20 percent. (As used herein, cross-machine direction "stretch" is the percent elongation to break in the cross-machine direction when using an Instron tensile tester). The height or z-directional dimension of the protrusions relative to the surface plane of the tissue sheet can be from about 0.005 inch (0.013 centimeters) to about 0.05 inch (0.13 centimeters), more specifically from about 0.005 inch (0.013 centimeters) to about 0.03 inch (0.076 centimeters), and still more specifically from about 0.01 inch (0.025 centimeters) to about 0.02 inch (0.051 centimeters), as measured in an uncreped and uncalendered state. Calendering will reduce the height of the protrusions, but will not eliminate them. The length of the protrusions in the machine direction can be from about 0.030 inch to about 0.425 inch, more specifically from about 0.05 inch to about 0.25 inch, and still more specifically from about 0.1 inch to about 0.2 inch.

In another aspect, the invention resides in a soft tissue product with a WCB of about 4.5 or greater, more specifically about 5.0 or greater, an LER of about 50% or greater, more specifically about 55% or greater, and a WS of about 50% or greater, more specifically about 60% or greater.

In a further aspect, the invention resides in a soft uncreped throughdried tissue product with a WCB of about 4.5 or greater, more specifically about 5.0 or greater, an LER of about 50% or greater, more specifically about 55% or greater, and a WS of about 50% or greater, more specifically about 60% or greater.

In still a further aspect, the invention resides in a method of making a soft tissue sheet comprising: (a) forming an aqueous suspension of papermaking fibers having a consistency of about 20 percent or greater; (b) mechanically working the aqueous suspension at a temperature of about 140° F. or greater provided by an external heat source, such as steam, with a power input of about 1 horsepower-day per ton of dry fiber or greater; (c) diluting the aqueous suspension of mechanically-worked fibers to a consistency of about 0.5 percent or less and feeding the diluted suspension to a layered tissue-making headbox providing two or more layers; (d) including a temporary or permanent wet strength additive in one or more of said layers; (e) depositing the diluted aqueous suspension onto a forming fabric to form a wet web; (f) dewatering the wet web to a consistency of from about 20 to about 30 percent; (g) transferring the dewatered web from the forming fabric to a transfer fabric traveling at a speed of from about 10 to about 80 percent slower than the forming fabric; (h) transferring the web to a throughdrying fabric whereby the web is macroscopically rearranged to conform to the surface of the throughdrying fabric; (i) throughdrying the web to final dryness and (j) subsequently calendering the web to achieve the desired final dry sheet caliper.

In addition, such tissue sheets can have a Wicking Rate of about 2.5 centimeters per 15 seconds or greater, more specifically from about 2.5 to about 4 centimeters per 15 seconds, and still more specifically from about 3 to about 3.5 centimeters per 15 seconds. The Wicking Rate is a standard parameter determined in accordance with ASTM D1776 (Specimen Conditioning) and TAPPI UM451 (Capillarity Test of Paper). The method involves dipping the test specimen edgewise into a water bath and measuring the vertical wicking distance the water travels in 15 seconds. For convenience, the specimens are weighted with a paper clip and initially submerged one inch below the surface of the water bath.

Further, the tissue sheets of this invention can have a bulk of about 12 cubic centimeters per gram or greater, more specifically from about 12 to about 25 cubic centimeters per gram, and still more specifically from about 13 to about 20 cubic centimeters per gram. As used herein, sheet bulk is the caliper of a single ply of product divided by its basis weight. Caliper is measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board". The micrometer used for carrying out T411 om-89 is a Bulk Micrometer (TMI Model 49-72-00, Amityville, N.Y.) having an anvil pressure of 80 grams per square inch (per 6.45 square centimeters).

Furthermore, such tissue sheets having a basis weight in the range of from about 10 to about 70 grams per square meter can have a flexibility, as measured by the quotient of the geometric mean modulus divided by the geometric mean tensile strength (hereinafter defined with reference to FIGS. 5 and 6) of about 4.25 kilometers per kilogram or less, more specifically about 4 kilometers per kilogram or less, and still more specifically from about 2 to about 4.25 kilometers per kilogram.

Furthermore, such tissue sheets having a basis weight in the range of from about 10 to about 70 grams per square meter can have an MD Stiffness value (hereinafter defined) of about 100 kilogram-microns$^{1/2}$ or less, more specifically about 75 kilogram-microns$^{1/2}$ or less and still more specifically about 50 kilogram-microns$^{1/2}$ or less.

Still further, the tissue sheets of this invention can have an Absorbent Capacity (hereinafter defined) of about 11 grams of water per gram of fiber or greater, more specifically from about 11 to about 14 grams per gram. The Absorbent Capacity is determined by cutting 20 sheets of product to be tested into a 4 inch by 4 inch square and stapling the corners together to form a 20 sheet pad. The pad is placed into a wire mesh basket with the staple points down and lowered into a water bath (30° C.). When the pad is completely wetted, it is removed and allowed to drain for 30 seconds while in the wire basket. The weight of the water remaining in the pad after 30 seconds is the amount absorbed. This value is divided by the weight of the pad to determine the Absorbent Capacity.

With respect to the use of wet strength agents, there are a number of materials commonly used in the paper industry to impart wet strength to paper and board that are applicable to this invention. These materials are known in the art as wet strength agents and are commercially available from a wide variety of sources. Any material that when added to a paper or tissue results in providing a tissue or paper with a wet strength:dry strength ratio in excess of 0.1 will, for purposes of this invention, be termed a wet strength agent. Typically these materials are termed either as permanent wet strength agents or as "temporary" wet strength agents. For the purposes of differentiating permanent from temporary wet strength, permanent will be defined as those resins which, when incorporated into paper or tissue products, will provide a product that retains more than 50% of its original wet strength after exposure to water for a period of at least five minutes. Temporary wet strength agents are those which show less than 50% of their original wet strength after exposure to water for five minutes. Both classes of material find application in the present invention. The amount of wet strength agent added to the pulp fibers can be at least about 0.1 dry weight percent, more specifically about 0.2 dry weight percent or greater, and still more specifically from about 0.1 to about 3 dry weight percent based on the dry weight of the fibers.

Permanent wet strength agents will provide a more or less long-term wet resilience to the structure. This type of structure would find application in products that would require long-term wet resilience such as in paper towels and in many absorbent consumer products. In contrast, the temporary wet strength agents would provide structures that had low density and high resilience, but would not provide a structure that had long-term resistance to exposure to water or body fluids. While the structure would have good integrity initially, after a period of time the structure would begin to lose its wet resilience. This property can be used to some advantage in providing materials that are highly absorbent when initially wet, but which after a period of time lose their integrity. This property could be used in providing "flushable" products. The mechanism by which the wet strength is generated has little influence on the products of this invention as long as the essential property of generating water-resistant bonding at the fiber/fiber bond points is obtained.

The permanent wet strength agents that are of utility in the present invention are typically water soluble, cationic oligomeric or polymeric resins that are capable of either crosslinking with themselves (homocrosslinking) or with the cellulose or other constituent of the wood fiber. The most widely-used materials for this purpose are the class of polymer known as polyamide-polyamine-epichlorohydrin (PAE) type resins. These materials have been described in patents issued to Keim (U.S. Pat. No. 3,700,623 and 3,772,076) and are sold by Hercules, Inc., Wilmington, Del., as Kymene 557H. Related materials are marketed by Henkel Chemical Co., Charlotte, N.C. and Georgia-Pacific Resins, Inc., Atlanta, Ga.

Polyamide-epichlorohydrin resins are also useful as bonding resins in this invention. Materials developed by Monsanto and marketed under the Santo Res label are base-activated polyamide-epichlorohydrin resins that can be used in the present invention. These materials are described in patents issued to Petrovich (U.S. Pat. Nos. 3,885,158; 3,899,388; 4,129,528 and 4,147,586) and van Eenam (U.S. Pat. No. 4,222,921). Although they are not as commonly used in consumer products, polyethylenimine resins are also suitable for immobilizing the bond points in the products of this invention. Another class of permanent-type wet strength agents are exemplified by the aminoplast resins obtained by reaction of formaldehyde with melamine or urea.

The temporary wet strength resins that can be used in connection with this invention include, but are not limited to, those resins that have been developed by American Cyanamid and are marketed under the name Parez 631 NC (now available from Cytec Industries, West Paterson, N.J. This and similar resins are described in U.S. Pat. Nos. 3,556,932 to Coscia et al. and 3,556,933 to Williams et al. Other temporary wet strength agents that should find application in this invention include modified starches such as those available from National Starch and marketed as Co-Bond 1000. It is believed that these and related starches are covered by U.S. Pat. No. 4,675,394 to Solarek et al. Derivatized dialdehyde starches, such as described in Japanese Kokai Tokkyo Koho JP 03,185,197, should also find application as useful materials for providing temporary wet strength. It is also expected that other temporary wet strength materials such as those described in U.S. Pat. Nos. 4,981,557; 5,008,344 and 5,085,736 to Bjorkquist would be of use in this invention. With respect to the classes and the types of wet strength resins listed, it should be understood that this listing is simply to provide examples and that this is neither meant to exclude other types of wet strength resins, nor is it meant to limit the scope of this invention.

Although wet strength agents as described above find particular advantage for use in connection with in this invention, other types of bonding agents can also be used to provide the necessary wet resiliency. They can be applied at the wet end or applied by spraying or printing, etc. after the web is formed or after it is dried.

Suitable papermaking fibers useful for purposes of this invention particularly include low yield chemical pulp fibers, such as softwood and hardwood kraft fibers. These fibers are relatively flexible compared to fibers from high yield pulps such as mechanical pulps. Although other fibers can be advantageously used in carrying out various aspects of this invention, the resiliency of the tissues of this invention is particularly surprising when low yield fibers are used.

The dryer fabrics useful for purposes of this invention are characterized by a top plane dominated by high and long MD impression knuckles or floats. There are no cross-machine direction knuckles in the top plane. The plane difference, which is the distance between the plane formed by the highest points of the long impression knuckles (the higher of the two planes) and the plane formed by the highest points of the shute knuckles, is from about 30 to 150 percent, more specifically from about 70 to about 110 percent, of the diameter of the warp strand(s) that form the impression knuckle. Warp strand diameters can be from about 0.005 inch (0.013 centimeters) to about 0.05 inch (0.13 centimeters), more specifically from about 0.005 inch (0.013 centimeters) to about 0.035 inch (0.09 centimeters), and still more specifically from about 0.010 inch (0.025 centimeters) to about 0.020 inch (0.051 centimeters).

The length of the impression knuckles is determined by the number of shute (CD) strands that the warp strand(s) that form the impression knuckle crosses over. This number can be from about 2 to about 15, more specifically from about 3 to about 11, and still more specifically from about 3 to about 7 shute strands. In absolute terms, the length of the impression knuckles can be from about 0.030 inch to about 0.425 inch, more specifically from about 0.05 inch to about 0.25 inch, and still more specifically from about 0.1 inch to about 0.2 inch.

These high and long impression knuckles, when combined with the lower sub-level plane of the cross-machine and machine direction knuckles, result in a topographical 3-dimensional sculpture. Hence the fabrics of this invention are sometimes referred to herein as 3-dimensional fabrics. The topographical sculpture has the reverse image of a stitch-and-puff quilted effect. When the fabric is used to dry a wet web of tissue paper, the tissue web becomes imprinted with the contour of the fabric and exhibits a quilt-like appearance with the images of the high impression knuckles appearing like stitches and the images of the sub-level planes appearing like the puff areas. The impression knuckles can be arranged in a pattern, such as a diamond-like shape, or a more free-flowing (decorative) motif such as fish, butterflies, etc. that are more pleasing to the eye.

From a fabric-manufacturing standpoint, it is believed that commercially available fabrics have heretofore been either a co-planar surface (that is, the top of the warp and shute knuckles are at the same height) or a surface where the shute knuckles are high. A coplanar surface can be obtained by either surface-sanding or heat-setting. In the latter case, the warps are generally straightened out and thus pulled down into the body of the fabric during the heat-setting step to enhance the resistance to elongation and to eliminate fabric wrinkling when used in high temperatures such as in the paper-drying process. As a result, the shute knuckles are popped up towards the surface of the fabric. In contrast, the impression knuckles of the fabrics useful in this invention remain above the plane of the fabric even after heat setting due to their unique woven structure.

In the various embodiments of the fabrics useful in accordance with this invention, the base fabric can be of any mesh or weave. The warp forming the high top-plane impression knuckles can be a single strand, or group of strands. The grouped strands can be of the same or different diameters to create a sculptured effect. The machine direction strands can be round or noncircular (such as oval, flat, rectangular or ribbon-like) in cross section. These warps can be made of polymeric or metallic materials or their combinations. The number of warps involved in producing the high impression knuckles can range from about 5 to 100 per inch (per 2.54 centimeters) on the weaving loom. The number of warps involved in the load-bearing layer can also range from about 5 to about 100 per inch on the weaving loom.

The percent warp coverage is defined as the total number of warps per inch of fabric times the diameter of the warp strands times 100. For the fabrics useful herein, the total warp coverage is greater than 65 percent, preferably from about 80 to about 100 percent. With the increased warp coverage, each warp strand bears less load under the paper machine operating conditions. Therefore, the load-bearing warps need not be straightened out to the same degree during the fabric heat-setting step to achieve elongation and mechanical stability. This helps to maintain the crimp of the high and long impression knuckles.

DETAILED DESCRIPTION OF THE DRAWING

Figure 1:
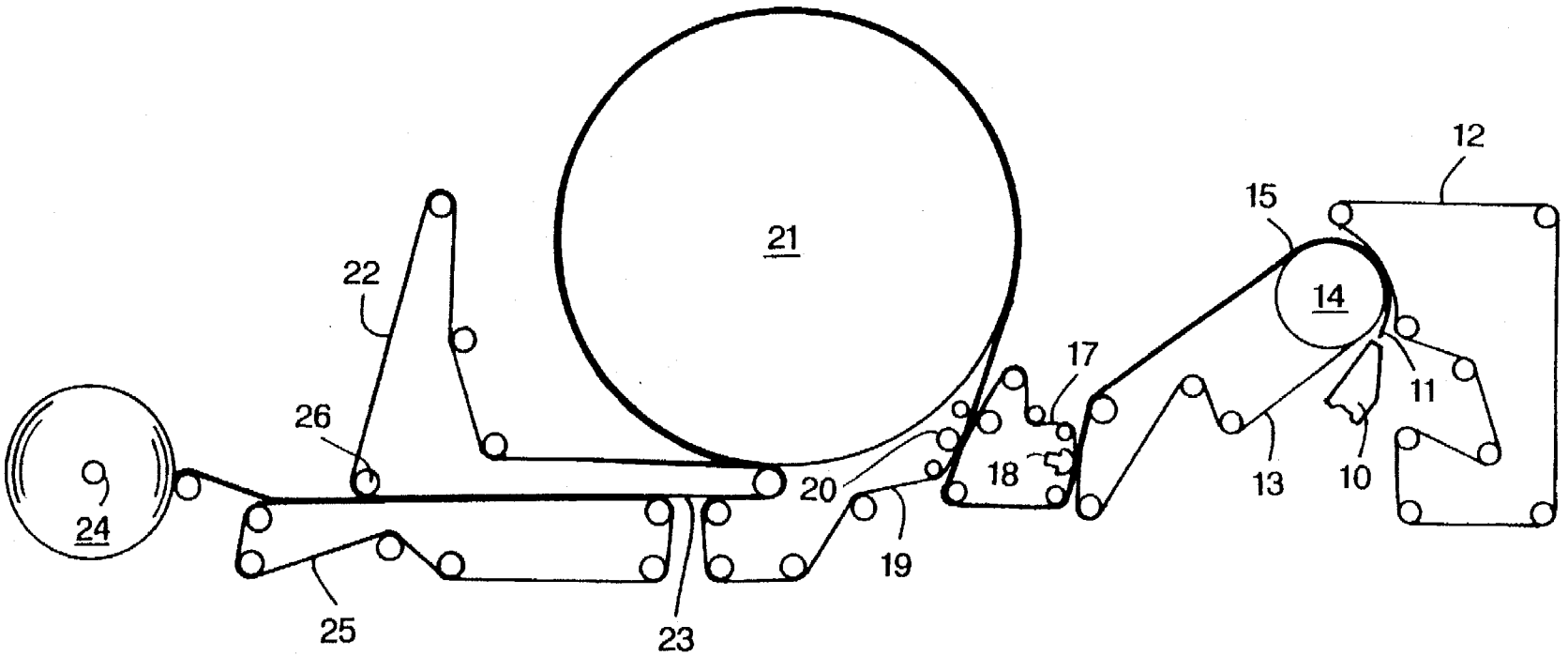
FIG. 1 is a schematic flow diagram for a method of making an uncreped tissue sheet in accordance with this invention.

Referring to FIG. 1, a method of carrying out this invention will be described in greater detail. Shown is a twin wire former having a layered papermaking headbox 10 which injects or deposits a stream 11 of an aqueous suspension of papermaking fibers onto the forming fabric 12. The web is then transferred to fabric 13, which serves to support and carry the newly-formed wet web downstream in the process as the web is partially dewatered to a consistency of about 10 dry weight percent. Additional dewatering of the wet web can be carried out, such as by vacuum suction, while the wet web is supported by the forming fabric.

The wet web is then transferred from the forming fabric to a transfer fabric 17 traveling at a slower speed than the forming fabric in order to impart increased MD stretch into the web. A kiss transfer is carried out to avoid compression of the wet web, preferably with the assistance of a vacuum shoe 18. The transfer fabric can be a fabric having impression knuckles as described in FIGS. 7–16 herein or it can be a smoother fabric such as Asten 934, 937, 939, 959 or Albany 94M. If the transfer fabric is of the impression knuckle type described herein, it can be utilized to impart some of the same properties as the throughdrying fabric and can enhance the effect when coupled with a throughdrying fabric also having the impression knuckles. When a transfer fabric having impression knuckles is used to achieve the desired CD stretch properties, it provides the flexibility to optionally use a different throughdrying fabric, such as one that has a decorative weave pattern, to provide additional desireable properties not otherwise attainable.

The web is then transferred from the transfer fabric to the throughdrying fabric 19 with the aid of a vacuum transfer roll 20 or a vacuum transfer shoe. The throughdrying fabric can be traveling at about the same speed or a different speed relative to the transfer fabric. If desired, the throughdrying fabric can be run at a slower speed to further enhance MD stretch. Transfer is preferably carried out with vacuum assistance to ensure deformation of the sheet to conform to the throughdrying fabric, thus yielding desired bulk, flexibility, CD stretch and appearance. The throughdrying fabric is preferably of the impression knuckle type described in FIGS. 7–16.

The level of vacuum used for the web transfers can be from about 3 to about 15 inches of mercury (75 to about 380 millimeters of mercury), preferably about 10 inches (254 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is final dried to a consistency of about 94 percent or greater by the throughdryer 21 and thereafter transferred to a carrier fabric 22. The dried basesheet 23 is transported to the reel 24 using carrier fabric 22 and an optional carrier fabric 25. An optional pressurized turning roll 26 can be used to facilitate transfer of the web from carrier fabric 22 to fabric 25. Suitable carrier fabrics for this purpose are Albany International 84M or 94M and Asten 959 or 937, all of which are relatively smooth fabrics having a fine pattern. Although not shown, reel calendering or subsequent off-line calendering can be used to improve the smoothness and softness of the basesheet.

In accordance with the invention, the throughdrying fabric has a top face which supports the pulp web 23 and a bottom face which confronts the throughdryer 21. Adjacent the bottom face, the fabric has a load-bearing layer which integrates the fabric while providing sufficient strength to maintain the integrity of the fabric as it travels through the throughdrying section of the paper machine, and yet is sufficiently porous to enable throughdrying air to flow through the fabric and the pulp web carried by it. The top face of the fabric has a sculpture layer consisting predominantly of elongated impression knuckles which project substantially above the sub-level plane between the load-bearing layer and the sculpture layer. The impression knuckles are formed by exposed segments of an impression yarn which span in the machine direction along the top face of the fabric, and are interlocked within the load-bearing layer at their opposite ends. The impression knuckles are spaced-apart transversely of the fabric, so that the sculpture layer exhibits valleys between the impression yarn segments and above the subplane between the respective layers.

Figure 2:
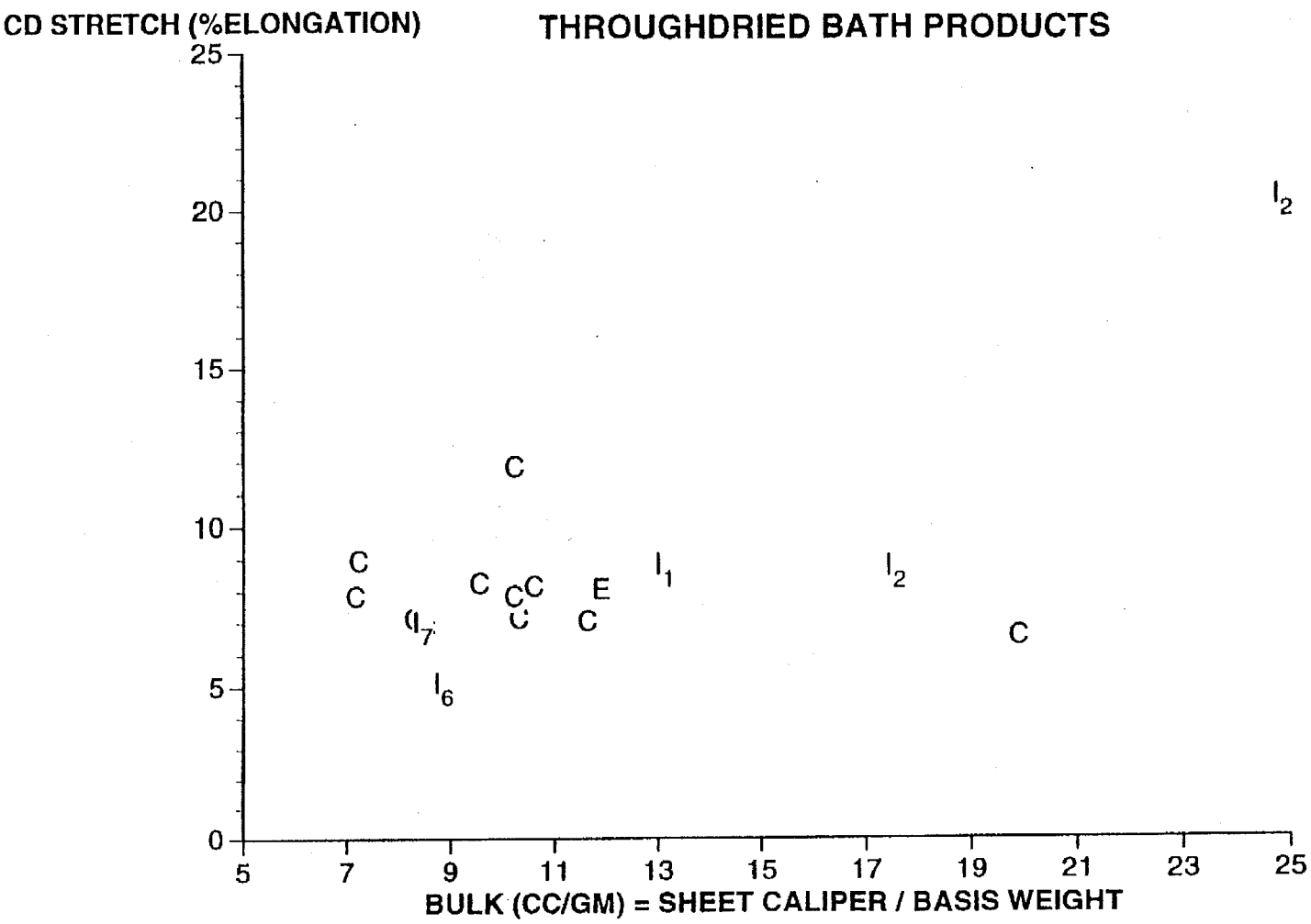
FIG. 2 is a plot of CD stretch versus bulk for various throughdried bath tissue products, illustrating the CD stretch attained with the uncreped products of this invention.

FIG. 2 is a plot of the CD stretch versus bulk for various throughdried bath tissue products, most of which are commercially available creped tissue products as designated by the letter "C". Point "E" is an experimental single-ply uncreped throughdried bath tissue made using the process as described in FIG. 1, but without using the 3-dimensional (impression knuckles) transfer or throughdrying fabrics described herein. Point "$I_1$" is a bath tissue product of this invention made using a Lindsay Wire T216-3 topological fabric having a mesh count of 72 by 40. The MD strand diameter was 0.013 inch while the CD strand diameter was 0.012 inch. There were approximately 20 impression knuckles per lineal inch in the CD direction and about 100 impression knuckles per square inch with a plane difference of about 0.012 inch. Points $I_2$ are also a bath tissue products of this invention, but made with a Lindsay Wire T116-3 topological fabric having a mesh count of 71 by 64. The MD strand diameter was 0.013 inch and the CD strand diameter was 0.014 inch. The MD strands were paired. There were approximately 10 impression knuckles per lineal inch in the CD direction and about 40 impression knuckles per square inch with a plane difference of about 0.012 inch. The difference between the two $I_2$ products is that theone with lower bulk was made using a higher headbox jet velocity to provide an MD/CD strength ratio of about 1.5, whereas the higher bulk product was made with a slower headbox jet velocity and had an MD/CD strength ratio of about 3. $I_6$ and $I_7$ are more heavily calendered bathroom tissues made according to this invention and described in detail in Examples 6 and 7.

As shown, the products of this invention possess a combination of high bulk and high CD Stretch and also can exhibit extremely high CD Stretch values.

Figure 3:
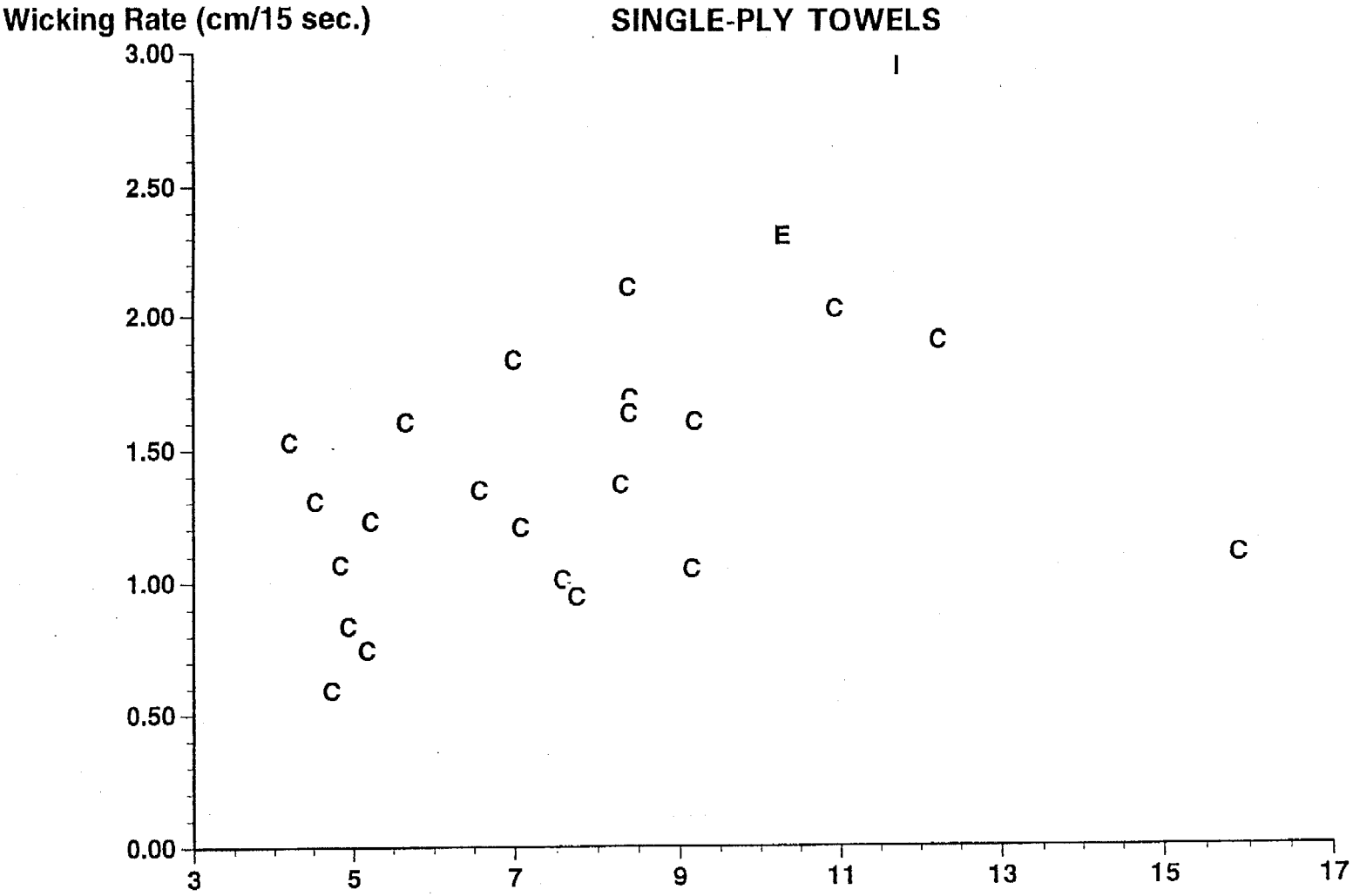
FIG. 3 is a plot of Wicking Rate versus bulk for a number of single-ply paper towels, illustrating the increase in Wicking Rate attained by the products of this invention.

FIG. 3 is a plot of the Wicking Rate versus bulk for various single-ply paper towels. As with FIG. 2, commercially available products are designated by the letter "C", an experimental uncreped throughdried towel product not made with the 3-dimensional fabrics described herein is designated by the letter "E", and a towel product of this invention made using a 3-dimensional throughdrying fabric is designated by the letter "I". Note the difference in Wicking Rate between product E and product I, both of which were made using the same process, differing only in the use of the 3-dimensional throughdrying fabric in the case of the product of this invention.

As illustrated, the product of this invention has a higher Wicking Rate than either the control experimental product or the commercially available towel products.

Figure 4:
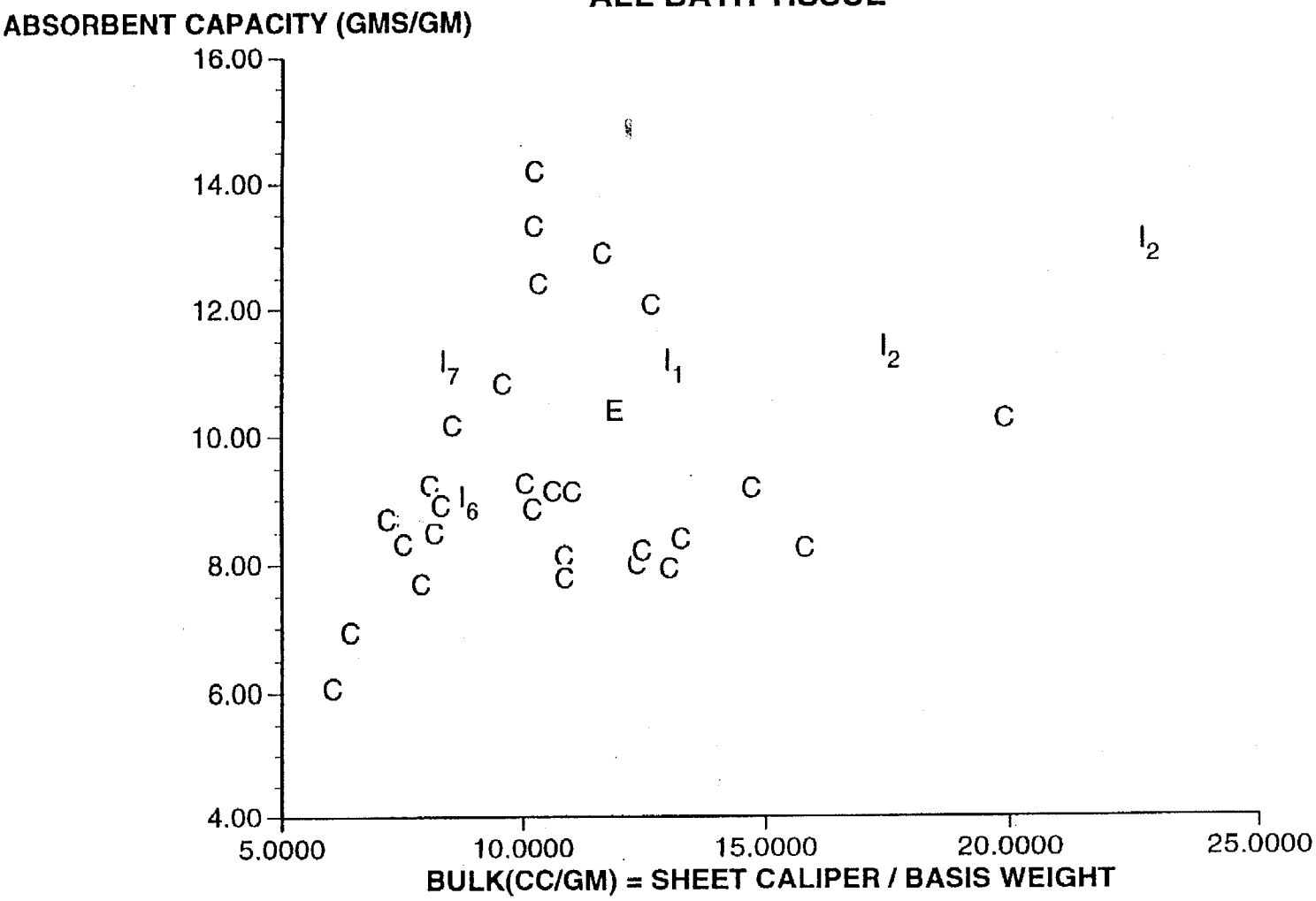
FIG. 4 is a plot of Absorbent Capacity versus bulk for bath tissue products, illustrating the high absorbent capacity of the products of this invention.

FIG. 4 is a plot of the Absorbent Capacity versus bulk for bath tissue products. Commercially available products are designated by the letter "C", an experimental uncreped throughdried bath tissue not made with the 3-dimensional fabrics described herein is designated by the letter "E", and products of this invention made using the 3-dimensional fabrics described herein are designated by the letter "I". $I_1$ and $I_2$ are as described in connection with FIG. 2. $I_6$ and $I_7$ are more heavily calendered bathroom tissues made according to this invention and described in detail in Examples 6 and 7. As shown, the products of this invention have a combination of high bulk and high Absorbent Capacity.

Figure 5:
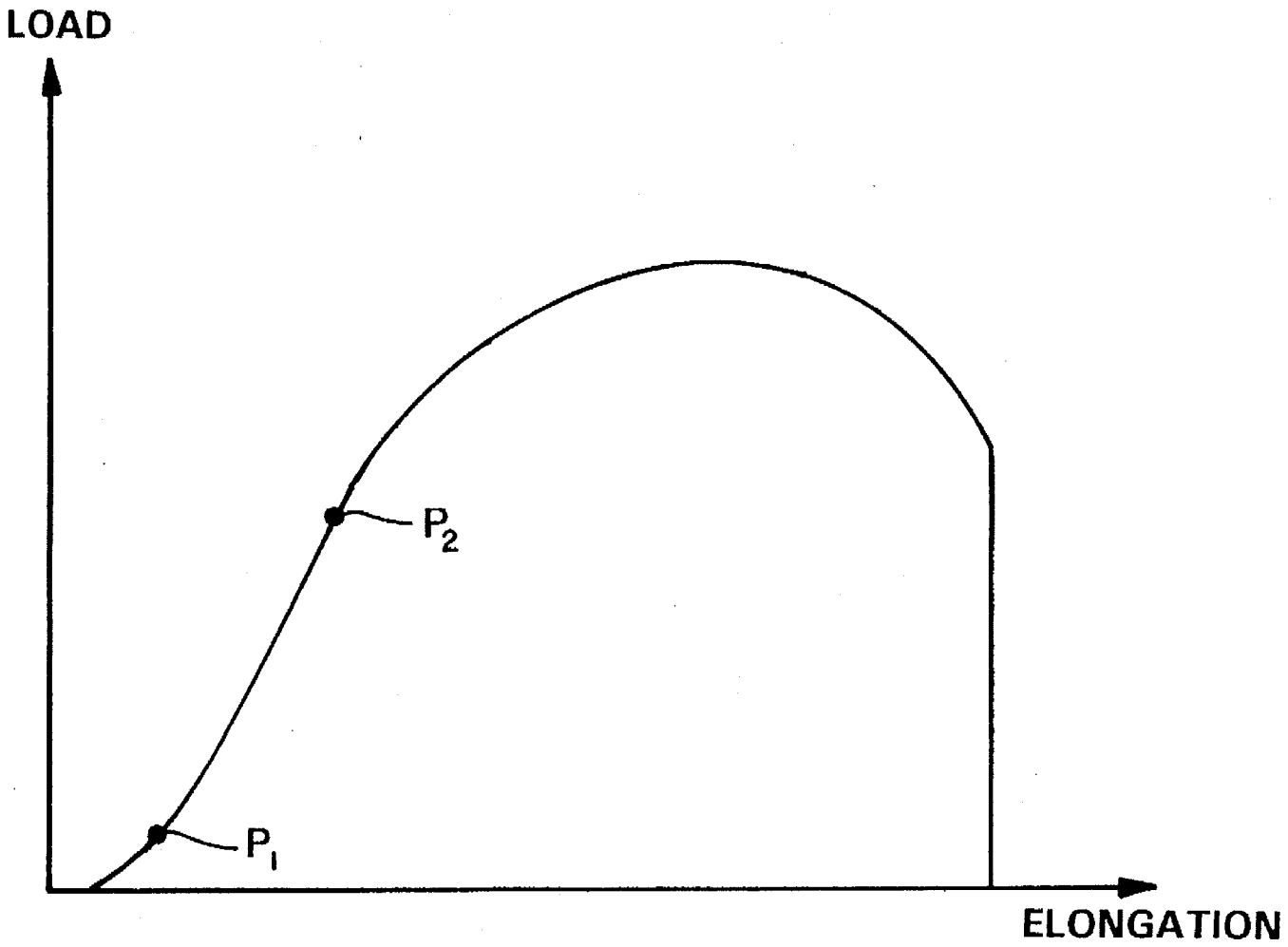
FIG. 5 is a generalized load/elongation curve for a tissue sheet to illustrate the determination of the geometric mean modulus.

FIG. 5 is a generalized load/elongation curve for a tissue sheet, illustrating the determination of either the machine direction modulus or the cross-machine direction modulus. (The geometric mean modulus is the square root of the product of the machine direction modulus and the cross-machine direction modulus.) As shown, the two points P1 and P2 represent loads of 70 grams and 157 grams applied against a 3-inch wide (7.6 centimeters) sample. The tensile tester (General Applications Program, version 2.5, Systems Integration Technology Inc., Stoughton, Mass.; a division of MTS Systems Corporation, Research Triangle Park, N.C.) is programmed such that it calculates the slope between P1 and P2, which expressed as kilograms per 76.2 millimeters of sample width. The slope divided by the product of the basis weight (expressed in grams per square meter) times 0.0762 is the modulus (expressed in kilometers) for the direction (MD or CD) of the sample being tested.

Figure 6:
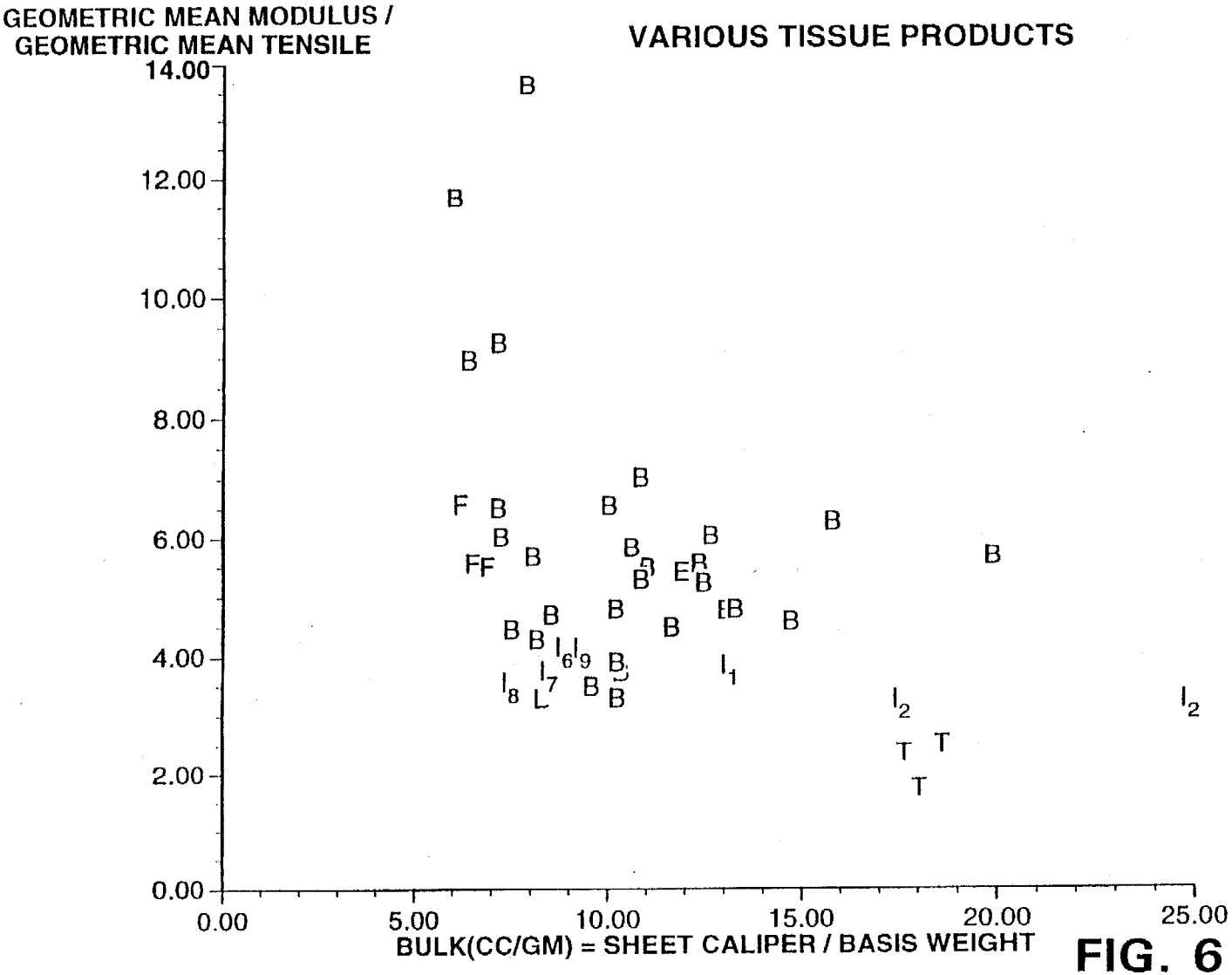
FIG. 6 is a plot of the quotient of the geometric mean modulus divided by the geometric mean tensile strength (flexibility) versus bulk for facial, bath and kitchen towels, illustrating the high degree of flexibility of the products of this invention.

FIG. 6 is a plot of the geometric mean modulus (GMM) divided by the geometric mean tensile (GMT) strength (flexibility) versus bulk for facial tissue, bath tissue and kitchen towels. Commercially available facial tissues are designated "F", commercially available bath tissues are designated "B", commercially available towels are designated "T", an experimental bath tissue not using the 3-dimensional fabrics described herein is designated "E", and bath tissues of this invention are designated "I". As before, $I_1$ and $I_2$ are made using the same fabrics, but the lower bulk $I_2$ has an MD/CD strength ratio of about 1.5 and the higher bulk $I_2$ has an MD/CD strength ratio of about 3. As shown, the products of this invention have very high bulk and a low quotient of the geometric mean modulus divided by the geometric mean tensile strength. $I_6$ and $I_7$ are more heavily calendered bathroom tissues made according to this invention and described in detail in Examples 6 and 7. $I_8$ and $I_9$ are calendered two-ply facial tissues made according to this invention and described in detail as Examples 8 and 9.

FIGS. 7–16 illustrate several 3-dimensional fabrics useful for purposes of this invention. For ease of visualization, the raised impression knuckles are indicated by solid black lines.

Figure 7:
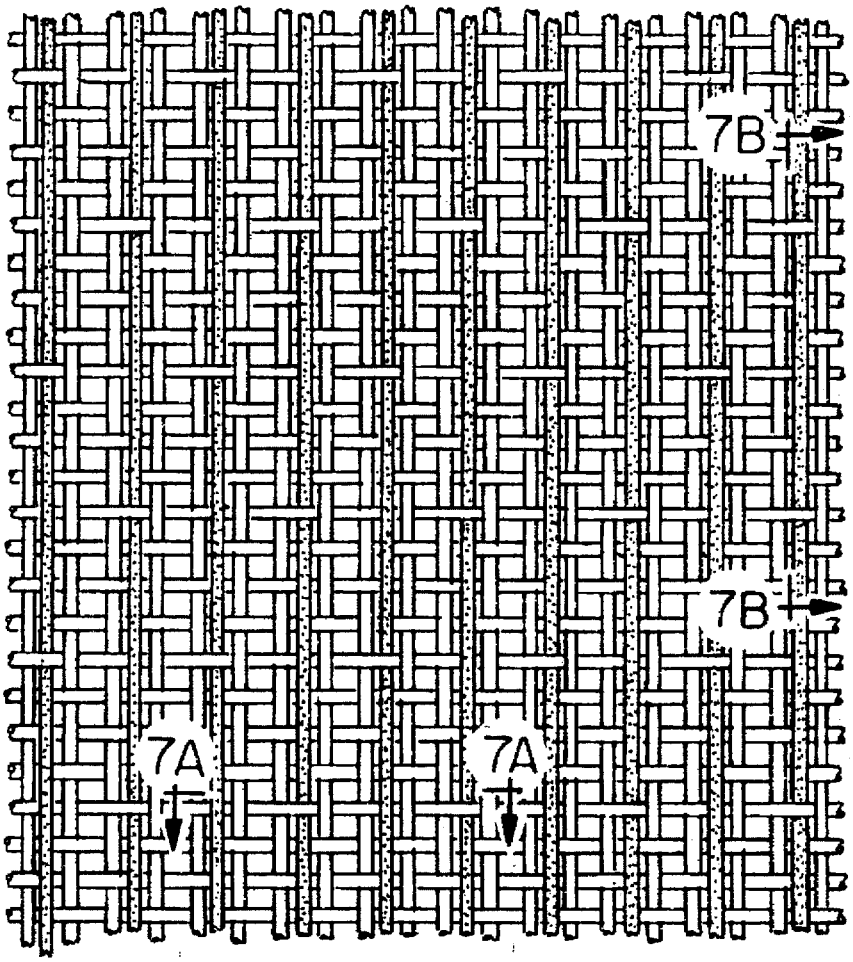
FIG. 7 is a plan view of a throughdrying or transfer fabric useful in accordance with this invention.
Figure 7B:
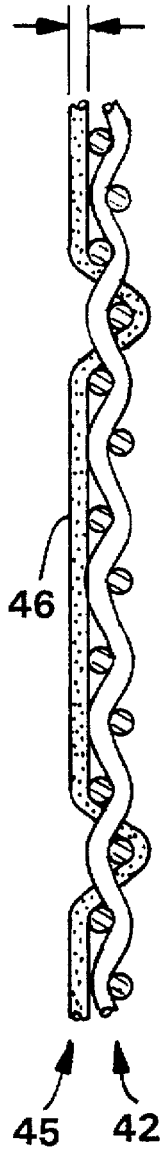
FIG. 7B is a different sectional view of the fabric of FIG. 7, further illustrating the weave pattern and the plane difference.
Figure 7A:
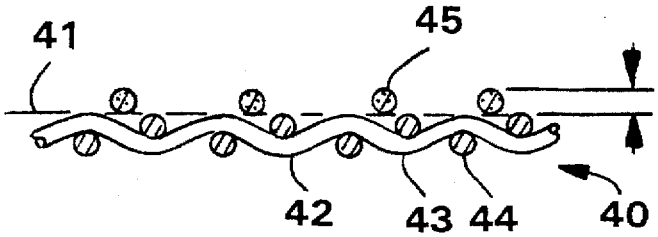
FIG. 7A is a sectional view of the fabric of FIG. 7, illustrating high and long impression knuckles and the plane difference.

FIGS. 7, 7A and 7B illustrate a first embodiment of a throughdrying fabric useful for purposes of this invention in which high impression knuckles are obtained by adding an extra warp system onto a simple 1×1 base design. The extra warp system can be "embroidered" onto any base fabric structure. The base structure becomes the load-bearing layer and at the sublevel plane it serves to delimit the sculpture layer. The simplest form of the base fabric would be a plain 1×1 weave. Of course, any other single, double, triple or multi-layer structures can also be used as the base.

Referring to these figures, the throughdrying fabric is identified by the reference character 40. Below a sublevel plane indicated by the broken line 41, the fabric 40 comprises a load-bearing layer 42 which consists of a plain-woven fabric structure having base warp yarns 43 interwoven with shute yarns 44 in a 1×1 plain weave. Above the sublevel plane 41, a sculpture layer indicated generally by the reference character 45 is formed by an impression strand segments 46 which are embroidered into the plain weave of the load-bearing layer 42. In the present instance, each impression segment 46 is formed from a single warp in an extra warp system which is manipulated so as to be embroidered into the load-bearing layer. The knuckles 46 provided by each warp yarn of the extra warp system are aligned in the machine direction in a close sequence, and the warp yarns of the system are spaced apart across the width of the fabric 40 as shown in FIG. 7. The extra warp system produces a topographical three-dimensional sculpture layer consisting essentially of machine-direction knuckles and the top surface of the load-bearing layer at the sublevel plane 41. In this fabric structure, the intermediate plane is coincident with the sublevel plane. The relationship between the warp knuckles 46 and the fabric structure of the load-bearing layer 42 produces a plane difference in the range of 30–150% of the impression strand diameter, and preferably from about 70–100% of the strand diameter. In the illustration of FIG. 7A, the plane difference is about 90% of the diameter of the strand 46. As noted above, warp strand diameters can range from 0.005 to about 0.05". For example, if the warp strand diameter is 0.012", the plane difference may be 0.10". For noncircular yarns, the strand diameter is deemed to be the vertical dimension of the strand, as it is oriented in the fabric, the strand normally being oriented with its widest dimension parallel to the sublevel plane.

In the fabric 40, the plain-weave load-bearing layer is constructed so that the highest points of both the load-bearing shutes and the load-bearing warps 42 and 43 are coplanar and coincident with the sublayer plane 41 and the yarns of the extra warp system 46 are positioned between the warps 44 of the load-bearing layer.

Figure 8:
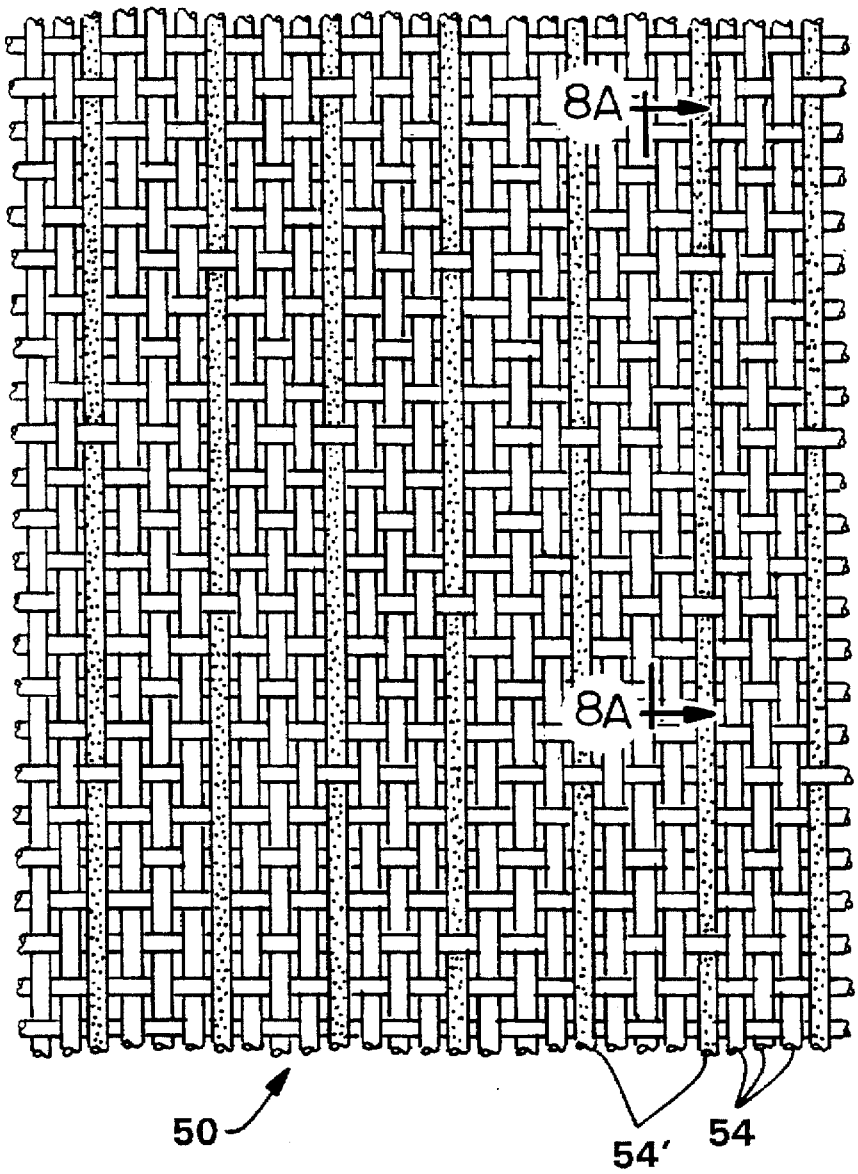
FIG. 8 is a plan view of another fabric useful in accordance with this invention.
Figure 8A:
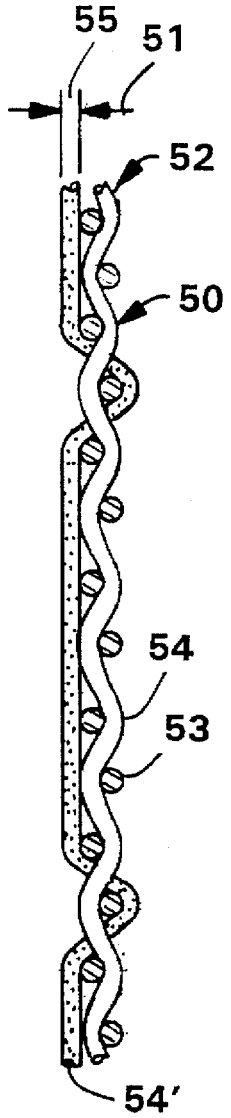
FIG. 8A is a sectional view of the fabric of FIG. 8.

FIGS. 8 and 8A illustrate a modification of the fabric 40 useful for purposes of this invention. The modified fabric 50 has a sublevel plane indicated by the broken line 51 with a load-bearing layer 52 below the plane 51 and a sculpture layer 55 above the plane 51. In this embodiment of the throughdrying fabric, the sculpture layer 55 has a three-dimensional pattern quite similar to the pattern of the sculpture layer 45 of the previously-described embodiment, consisting of a series of impression knuckles 54' arranged in the machine direction of the fabric and spaced apart in the cross direction of the fabric. In the fabric 50, the load-bearing layer is formed by shutes 53 and warps 54 interwoven in a plain weave for the most part.

In the weave of the load-bearing layer, certain shute knuckles project above the sublevel plane 51 and the tops of these shute knuckles define an intermediate plane 58. The plane difference between the top plane of the surface 55 and the intermediate plane 58 is at least 30% of the warp diameter. The sculpture layer 55, on the other hand, is formed by warp yarn segments drawn from the warp yarns 54' drawn from the load-bearing layer 52. The impression yarn segments 54' in the sculpture layer 55 are selected out from the warp system including the warps 54. In the present instance, in the warp system, which includes the warps 54 and 54', the first three warps in every four are components of the load-bearing layer 52 and do not project above the intermediate plane 58. The fourth warp, 54', however, consists of floats extending in the sculpture layer in the machine direction of the fabric above the sublevel plane 51 and the intermediate plane 58. The impression warps 54' are tied into the load-bearing layer 52 by passing under the shutes 53 in the load-bearing layer at the opposite ends of each float.

In the fabric 50, the warp strands 54' replace one of the base warps strands 54. When using this fabric as a throughdrying fabric, the uneven top surface of the load-bearing layer at the sublevel plane 51 imparts a somewhat different texture to the puff areas of the web than is produced by the sculpture layer of the fabric 40 shown in FIG. 7. In both cases, the stitch appearance provided by the valleys in the impression knuckles would be substantially the same since the impression knuckles float over seven shutes and are arranged in close sequence.

Figure 9:
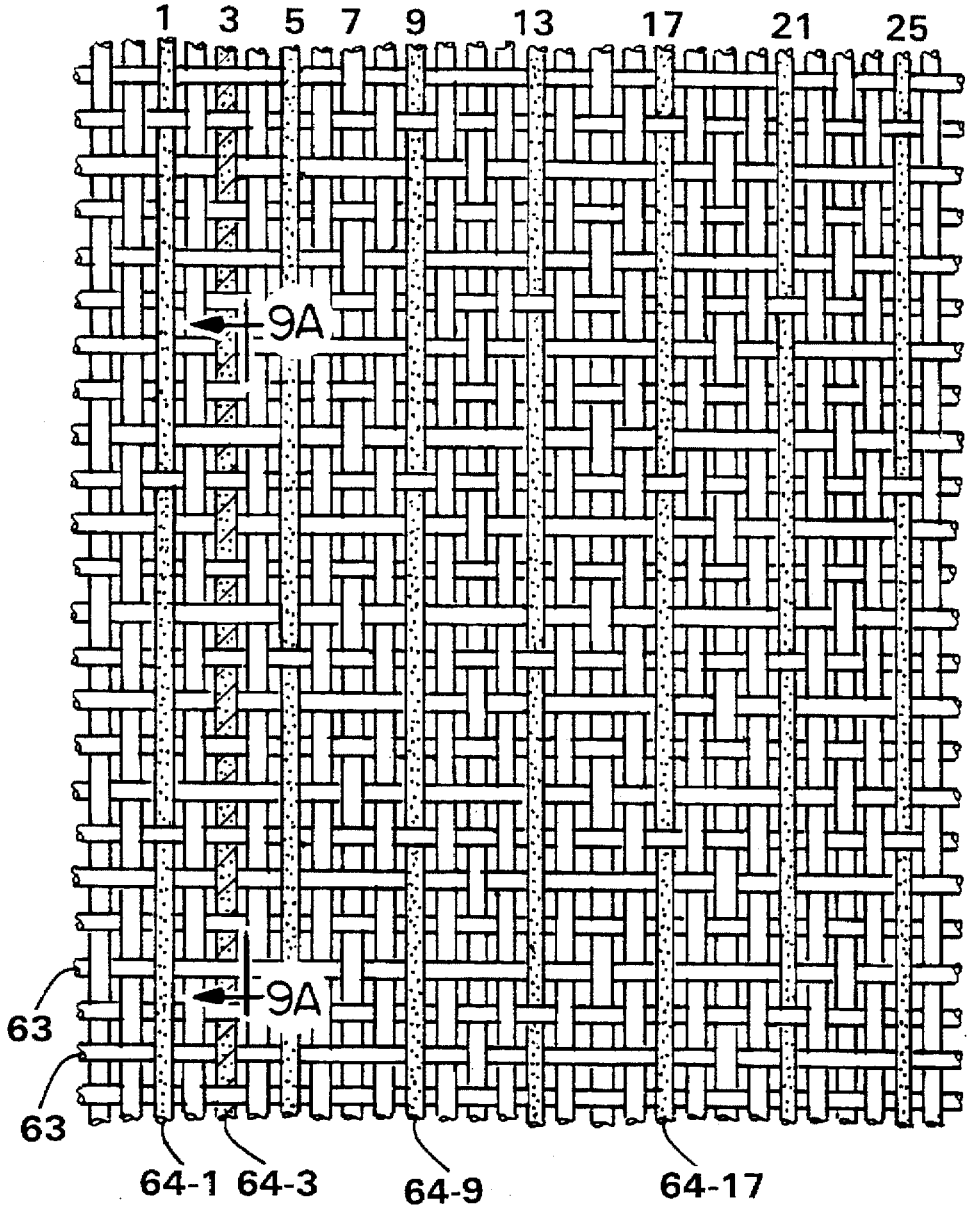
FIG. 9 is a plan view of another fabric useful in accordance with this invention.
Figure 9A:
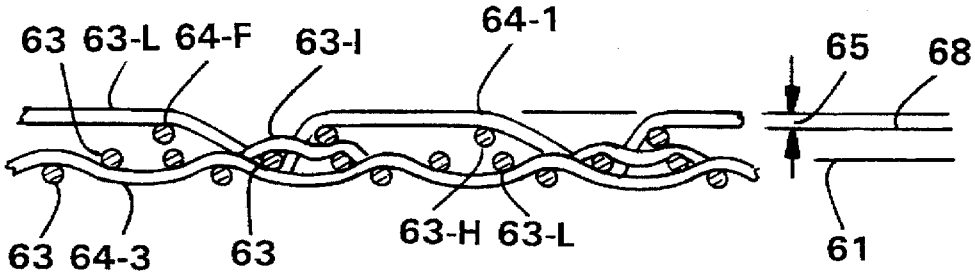
FIG. 9A is an enlarged longitudinal section of the fabric of FIG. 9, illustrating the position of the top surface, the intermediate plane and sublevel plane of the fabric.

FIGS. 9 and 9A illustrate another embodiment of the fabrics useful in connection with this invention. In this embodiment, the throughdrying fabric 60 has a sublevel plane indicated at broken lines at 61 and an intermediate plane indicated at 68. Below the sublevel plane 61, the load-bearing layer 62 comprises a fabric woven from shute yarns 63 and warp yarns 64. The sublevel plane 61 is defined by the high points of the lowest shute knuckles in the load-bearing layer 62, as identified by the reference character 63-L. The intermediate plane 68 is defined by the high points of the highest shute knuckles in the load-bearing layer 62, indicated by reference character 63-H. In the drawings, the warps 64 have been numbered in sequence across the top of FIG. 9 and these numbers have been identified in FIG. 9A with the prefix 64. As shown, the even-numbered warps follow the plain weave pattern of 1×1. In the odd-numbered warps, every fourth warp; i.e. warps 1, 5 and 9, etc., are woven with a 1×7 configuration, providing impression knuckles in the sculpture layer extending over seven shutes. The remaining odd-numbered warps; i.e. 3, 7, 11, etc., are woven with a 3×1 configuration providing warp floats under 3 shutes. This weaving arrangement produces a further deviation from the coplanar arrangement of the CD and MD knuckles at the sublevel plane that is characteristic of the fabric of FIG. 7 and provides a greater variation in the top surface of the load-bearing layer.

The tops of the MD and CD knuckles in the load-bearing layer fall between the intermediate plane 68 and the sublevel plane 61. This weave configuration provides a less abrupt stepwise elevation of the impression knuckles in the sculpture layer. The plane difference 65 in this embodiment; i.e., the distance between the highest point of the warps 64-1, 64-5, 64-9, etc. and the intermediate plane at the top of the load-bearing layer which represents the effective thickness of the sculpture layer is approximately 65% of the thickness of the impression strand segments of these warps that form the three-dimensional effect in the sculpture layer. It is noted that with the warp patterns of FIG. 9, the shutes 63 float over a plurality of warp yarns in the cross machine direction. Such cross machine floats, however, are confined to the body of the load-bearing layer below intermediate plane 68 and do not extend through the sculpture layer to reach the top face of the fabric 60. Thus, the fabric 60, like the fabrics 40 and 50, provide a load-bearing layer having a weave construction without any cross-direction knuckles projecting out of the base layer to reach the top face of the fabric. The three-dimensional sculpture provided by the sculpture layer in each of the embodiments consists essentially of elongated and elevated impression knuckles disposed in a parallel array above the sublevel plane and providing valleys between the impression knuckles. In each case, the valleys extend throughout the length of the fabric in the machine direction and have flow delineated by the upper surface of the load-bearing level at the sublevel plane.

Figure 16:
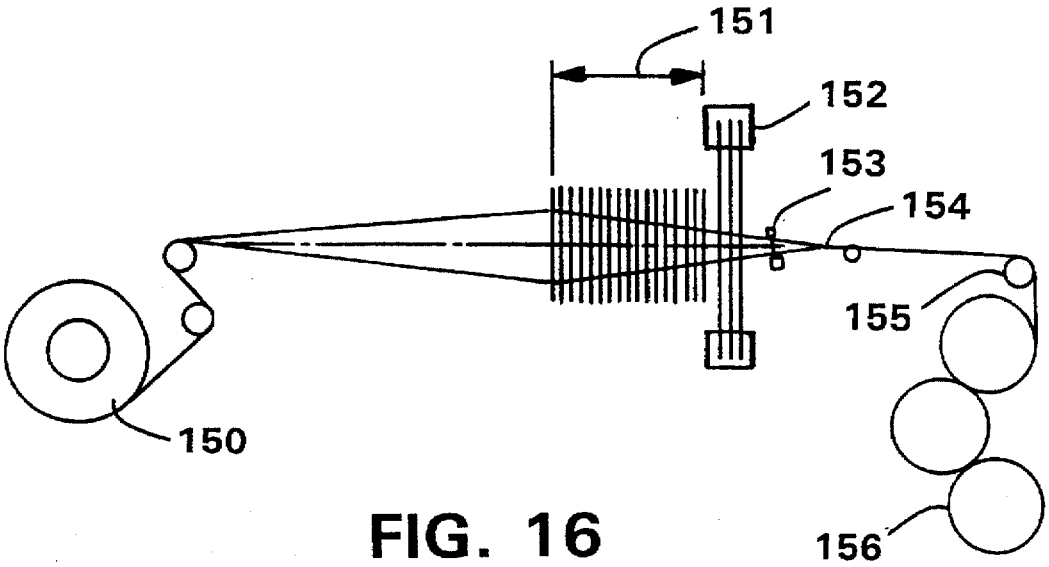
FIG. 16 is a schematic diagram of a standard fourdrinier weaving loom which has been modified to incorporate a jacquard mechanism for controlling the warps of an extra system to "embroider" impression warp segments into an otherwise conventional paper machine fabric.

The fabrics useful for purposes of the present invention are not limited to fabrics having a sculpture layer of this character, but complicated patterns such as Christmas trees, fish, butterflies, may be obtained by introducing a more complex arrangement for the knuckles. Even more complex patterns may be achieved by the use of a jacquard mechanism in conjunction with a standard fourdrinier weaving loom, as illustrated in FIG. 16. With a jacquard mechanism controlling an extra warp system, patterns may be achieved without disturbing the integrity of the fabric which is obtained by the load-bearing layer. Even without a supplemental jacquard mechanism, more complex weaving patterns can be produced in a loom with multiple heddle frames. Patterns such as diamonds, crosses or fishes may be obtained on looms having up to 24 heddle frames.

Figure 10:
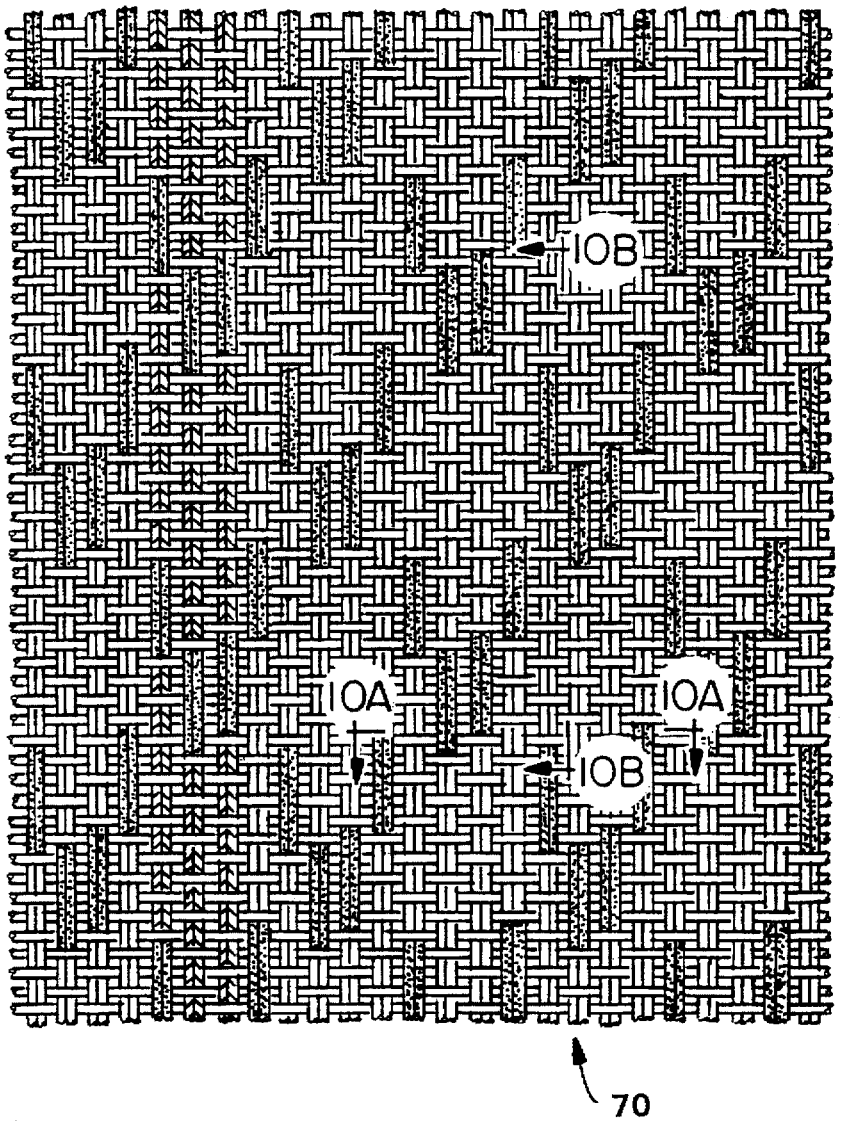
FIG. 10 is a plan view of another fabric useful in accordance with this invention.
Figure 10B:
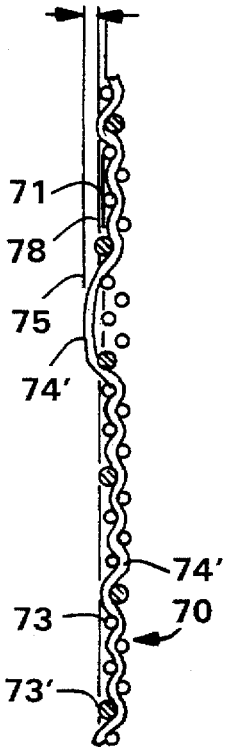
FIG. 10B is a longitudinal sectional view of the fabric of FIG. 10.
Figure 10A:
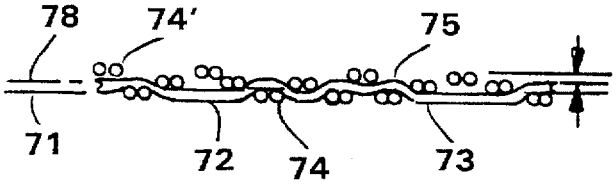
FIG. 10A is a transverse sectional view of the fabric of FIG. 10 taken on line 10A–10A.

For example, FIGS. 10, 10A and 10B illustrate a throughdrying fabric 70 having a load-bearing layer 72 below a sublevel plane 71 and a sculpture layer 75 above that plane. In the weave construction illustrated, the warps 74 of the load-bearing layer 72 are arranged in pairs to interweave with the shutes 73. The shutes are woven with every fifth shute being of larger diameter as indicated at 73'. The weave construction of the layer 72 and its locking-in of the impression warp knuckles raises selected shute knuckles above the sublevel plane to produce an intermediate plane 78. To obtain a diamond, such as shown in FIG. 10, the pairs of warps are elevated out of the load-bearing layer 72 to float within the pattern layer 75 as impression knuckles 74' extending in the machine direction of the fabric across the top surface of the load-bearing layer 72 at the sublevel plane 71. The warp knuckles 74' are formed by segments of the same warp yarns which are embodied in the load-bearing layer and are arranged in a substantially diagonal criss-cross pattern as shown. This pattern of impression knuckles in the sculpture layer 75 consists essentially of warp knuckles without intrusion of any cross machine knuckles.

In the fabric 70, the warps 74 are manipulated in pairs within the same dent, but it may be desired to operate the individual warps in each pair with a different pattern to produce the desired effect. It is noted that the impression knuckles in this embodiment extend over five shutes to provide the desired diamond pattern. The length of the impression knuckles may be increased to elongate the pattern or reduced to as little as three shutes to compress the diamond pattern. The fabric designer may come up with a wide variety of interesting complex patterns by utilization of the full patterning capacity of the particular loom on which the fabric is woven.

In the illustrated embodiments, all of the warps and shutes are substantially of the same diameter and are shown as monofilaments. It is possible to substitute other strands for one or more of these elements. For example, the impression strand segments which are used to form the warp knuckles may be a group of strands of the same or of different diameters to create a sculpture effect. They may be round or noncircular, such as oval, flat, rectangular or ribbon-like in cross section. Furthermore, the strands may be made of polymeric or metallic materials or a combination of the same.

Figure 11:
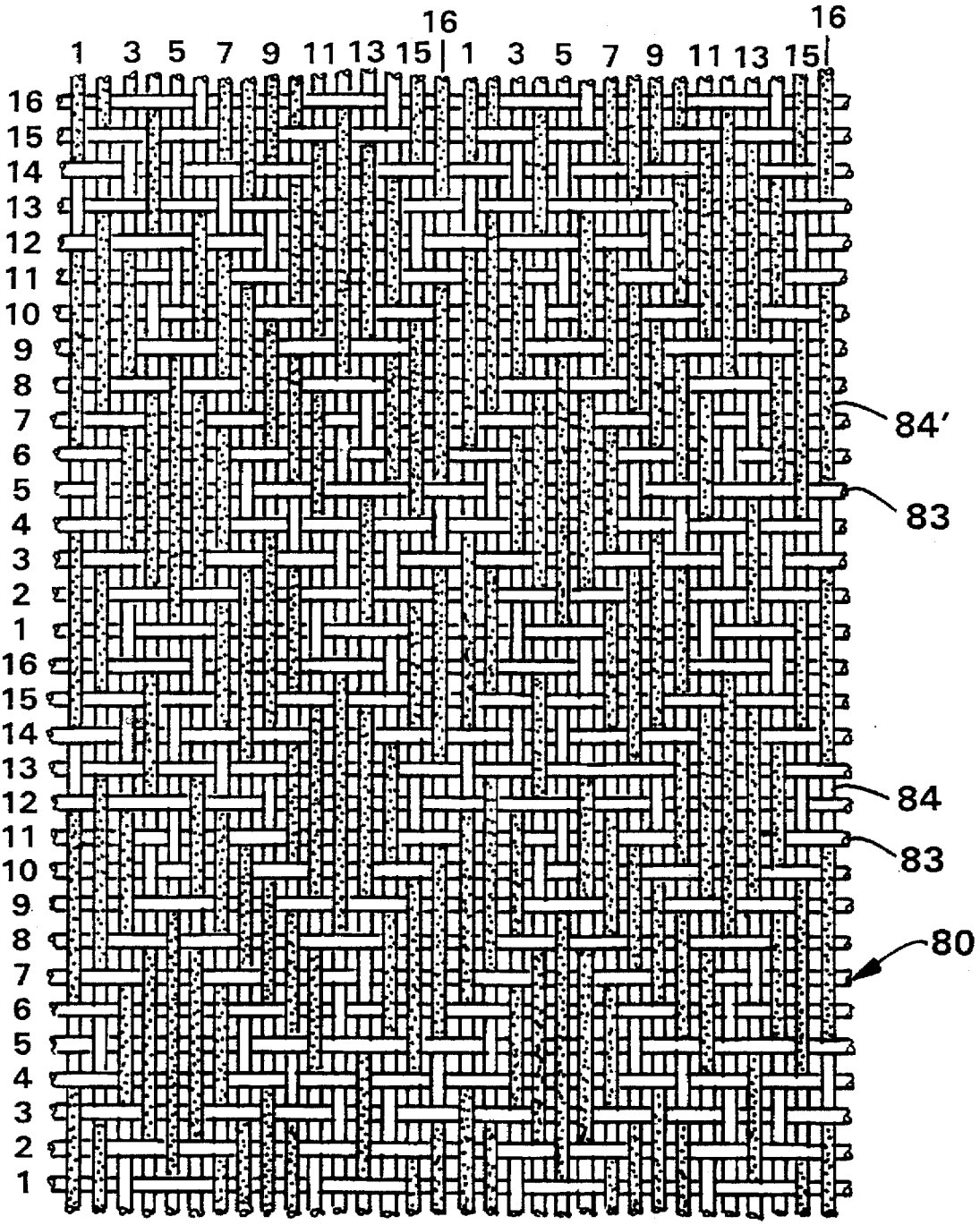
FIGS. 11 and 12 are plan views of additional fabrics useful for purposes of this invention.

FIG. 11 illustrates a throughdrying fabric 80 in which the sculpture layer provides impression warp knuckles 84' clustered in groups and forming valleys between and within the clustered groups. As shown, the warp knuckles 84' vary in length from 3–7 shutes. As in the previous embodiments, the load-bearing layer comprising shutes 83 and warps 84 is differentiated from the sculpture level at the sublevel plane, and the tops of the shute knuckles define an intermediate plane which is below the top surface of the sculpture layer by at least 30% of the diameter of the impression strands forming the warp knuckles. In the illustrated weave, the plane is between 85% and 100% of the impression warp knuckle diameter.

Figure 12:
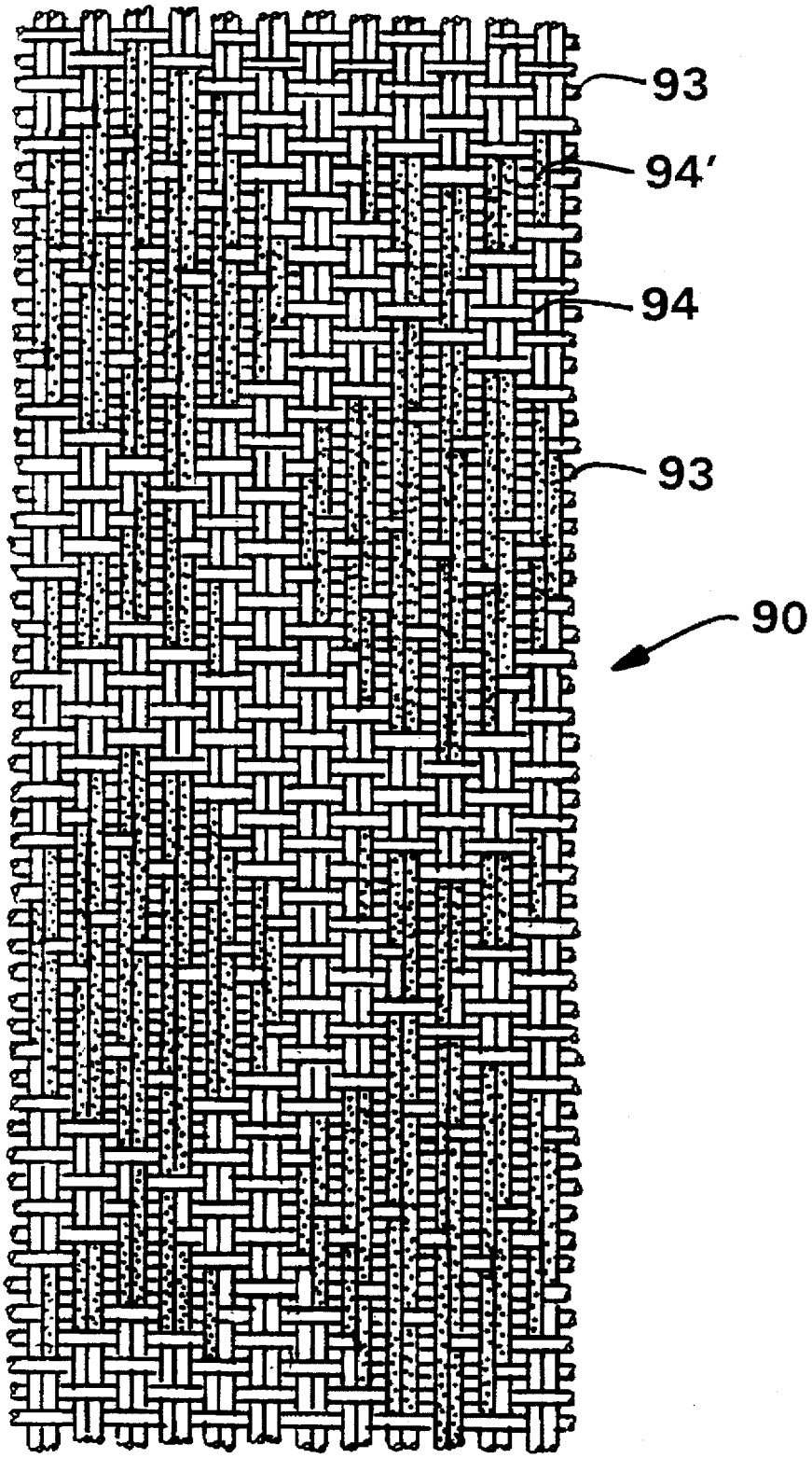

FIG. 12 illustrates a fabric 90 with impression strand segments 94' in a sculpture layer above the shutes 93 and warp 94 of the load-bearing layer. The warp knuckles 94' combine to produce a more complex pattern which simulates fishes.

Figure 13:
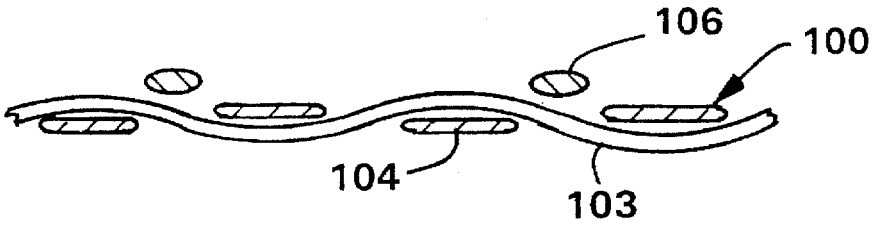
FIGS. 13–15 are transverse sectional views similar to FIG. 7A showing additional fabrics embodying non-circular warp strands useful for purposes of this invention.

FIG. 13 illustrates a fabric 100 in which the impression strands 106 are flat yarns, in the present instance ovate in cross-section, and the warp yarns 104 in the load-bearing layer are ribbon-like strands. The shute yarns 103, in the present case, are round. The fabric 100 shown in FIG. 14 provides a throughdrying fabric having reduced thickness without sacrificing strength.

Figure 14:
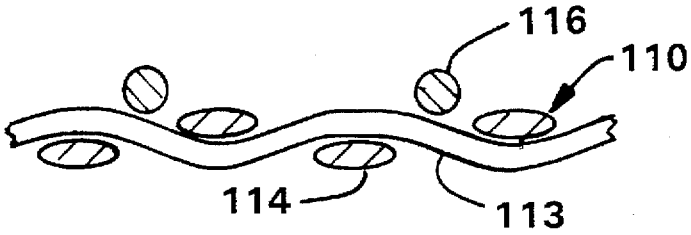

FIG. 14 illustrates a throughdrying fabric 110 in which the impression strands 116 are circular to provide a sculpture layer. In the load-bearing layer, the fabric comprises flat warps 114 interwoven with round shutes 113.

Figure 15:
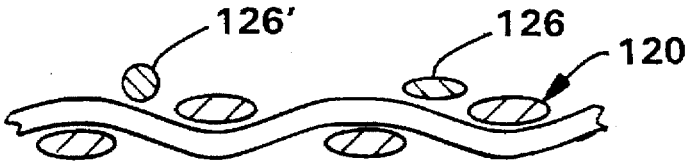

FIG. 15 illustrates a fabric 120 embodying flat warps 124 interwoven with shutes 123 in the load-bearing layer. In the pattern layer, the warp knuckles are formed from a combination of flat warps 126 and round warps 126'.

A wide variety of different combinations may be obtained by combining flat, ribbon-like, and round yarns in the warps of the fabric, as will be evident to a skilled fabric designer.

FIG. 16 illustrates a fourdrinier loom having a jacquard mechanism for "embroidering" impression yarns in the base fabric structure to produce a sculpture layer overlying the load-bearing layer.

The figure illustrates a back beam 150 for supplying the warps from the several warp systems to the loom. Additional back beams may be employed, as is known in the art. The warps are drawn forwardly through a multiple number of heddle frames 151 which are controlled by racks, cams and/or levers to provide the desired weave patterns in the load-bearing layer of the throughdrying fabric. Forwardly of the heddle frames 151, a jacquard mechanism 152 is provided to control additional warp yarns which are not controlled by the heddles 151. The warps drawn through the jacquard heddles may be drawn off the back beam 150 or alternatively may be drawn off from a creel (not shown) at the rear of the loom. The warps are threaded through a reed 153 which is reciprocally mounted on a sley to beat up the shutes against the fell of the fabric indicated at 154. The fabric is withdrawn over the front of the loom over the breast roll 155 to a fabric take-up roll 156. The heddles of the jacquard mechanism 152 are preferably controlled electronically to provide any desired weave pattern in the sculpture level of the throughdrying fabric being produced. The jacquard control enables an unlimited selection of fabric patterns in the sculpture layer of the fabric. The jacquard mechanism may control the impression warps of the sculpture layer to interlock with the load-bearing layer formed by the heddles 151 in any sequence desired or permitted by the warp-supply mechanism of the loom.

While a key feature of the woven fabrics taught here is the presence of long MD raised knuckles to impart CD stretch in the uncreped throughdried sheet, it should be understood that other fabric manufacturing techniques capable of producing equivalent MD elongated regions raised significantly above the plane of the drying fabric would be expected to give similar sheet characteristics. Examples include the application of ultra-violet-cured polymers to the surface of traditional fabrics as taught by Johnson et al. (U.S. Pat. No. 4,514,345) or suggested by the technique of "rapid prototyping" (*Mechanical Engineering*, April 1991, pp. 34–43).

Figure 17:
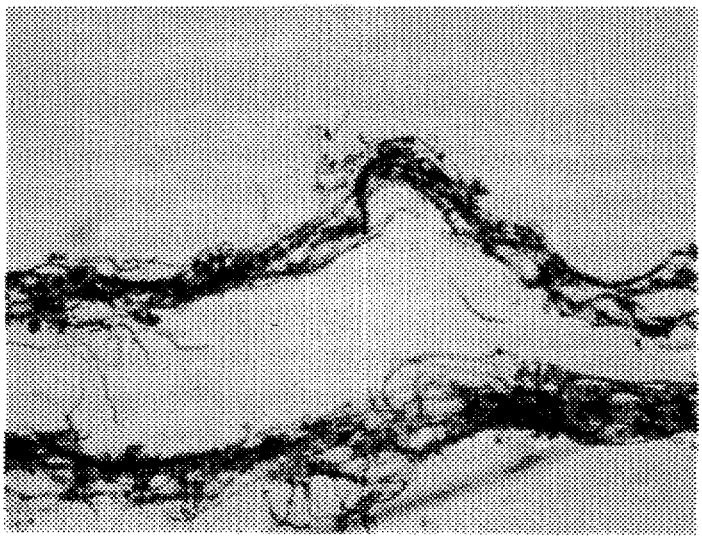
FIG. 17 is a cross-sectional photograph of a tissue made in accordance with this invention.

FIG. 17 is a cross-sectional photograph of a tissue made in accordance with this invention (magnified 50×). The upper cross-section is viewed in the cross-machine direction and the lower cross-section is viewed in the machine direction, both illustrating the vertical protrusions produced in the tissue by the raised warp knuckles in the throughdrying fabric. As illustrated, the heights of the protrusions can vary within a certain range and are not necessarily all the same height. In the photograph, the cross-sections are of two different protrusions in close proximity to each other on the same tissue sheet. A feature of the products of this invention is that the density of the sheet is uniform or substantially uniform. The protrusions are not of different density than the balance of the sheet.

Figure 18:
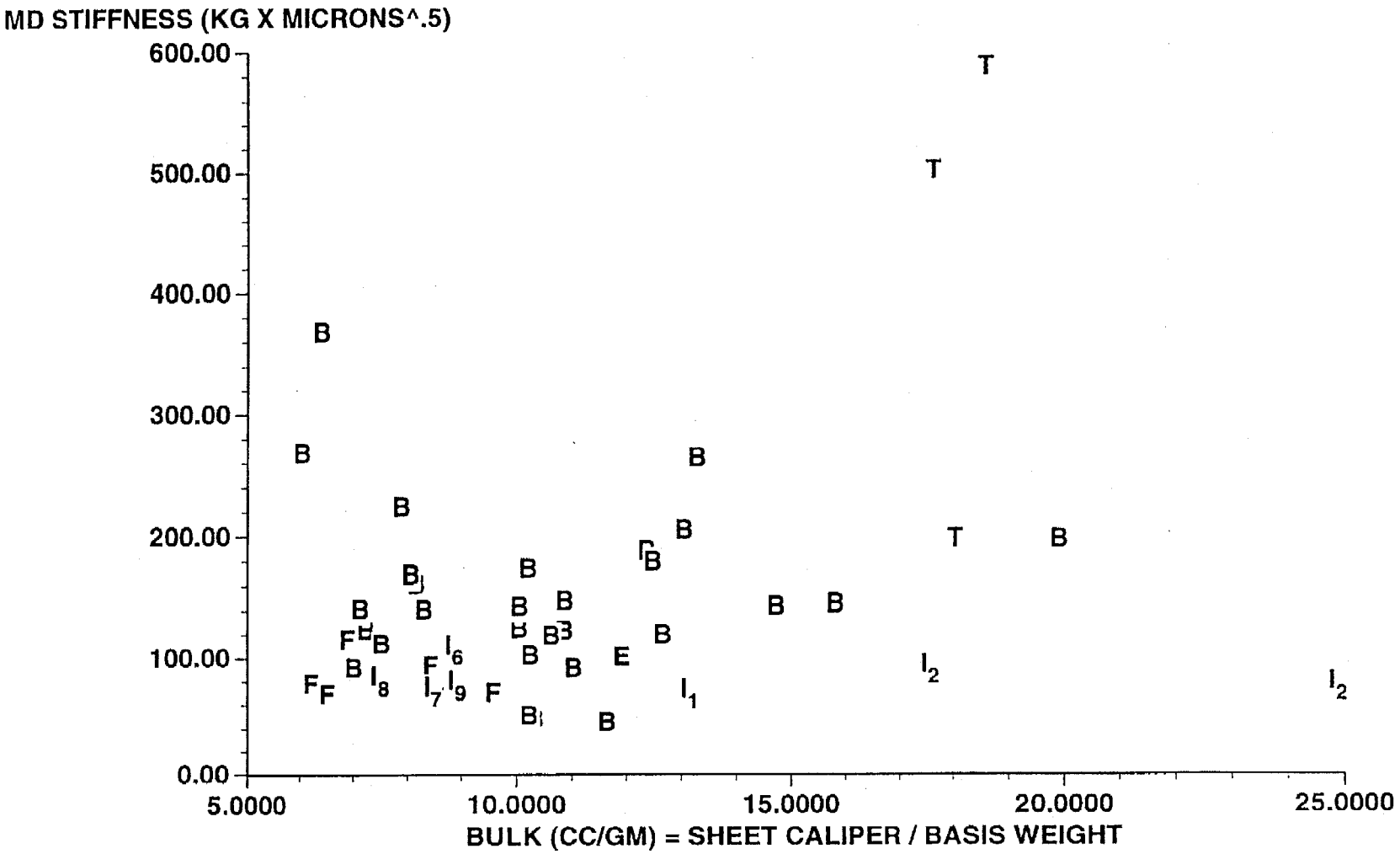
FIG. 18 is a plot of MD Stiffness versus Bulk for a variety of commercial facial, bath and towel products, illustrating the high bulk and low stiffness of the products of this invention.

FIG. 18 is a plot of MD Stiffness vs. Bulk for a wide range of tissue products. In some instances the MD Stiffness value represents an improvement over GMM/GMT for quantifying stiffness in that the effects of thickness and multiple plies are taken into account. The MD Stiffness value has been seen to correlate with the human perception of stiffness over a wide range of products and can be calculated as the MD Slope (expressed in kilograms) multiplied by the square root of the quotient of the sheet caliper (in microns) divided by the number of plies. [MD Stiffness=(MD Slope) (sheet caliper/number of plies)$^{1/2}$]. Sheets of this invention are characterized as having MD Stiffness values of 100 kilogram-microns$^{1/2}$ or less. These sheets are unique in their ability to combine low MD Stiffness with high bulk.

Figure 19:
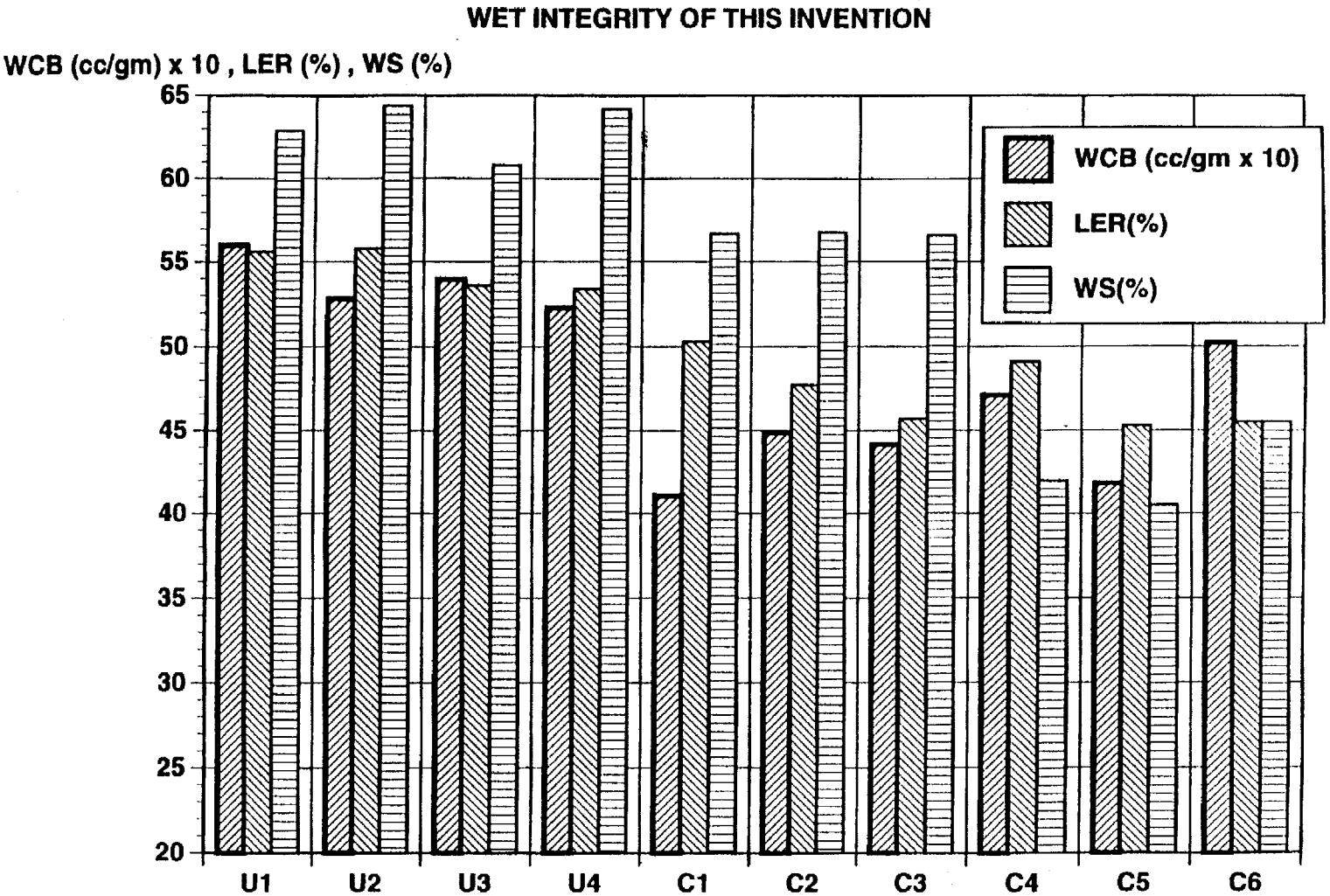
FIG. 19 is a chart showing the WCB, LER and WS for several examples of this invention as well as several competitive products.

FIG. 19 compares the WCB, LER and WS of products made by this invention with several competitive products. $U_1$, $U_2$, $U_3$ and $U_4$ are products made by this invention and described in detail in Examples 10–13 respectively. $C_1$ to $C_6$ are commercially available bathroom tissue products. More specifically, $C_1$–$C_3$ are three samples of CHARMIN® while $C_4$–$C_6$ are COTTONELLE®, QUILTED NORTHERN® and ULTRA-CHARMIN® respectively. Tissues of this invention are superior in terms of their ability to simultaneously achieve high values for WCB, LER and WS. A description of the test method for measuring WCB, LER and WS follows.

Equipment Set-Up

An Instron 4502 Universal Testing Machine is used for this test. A 1 kN load cell is mounted below (on the lower side of) the cross beam. Instron compression platens with 2.25 inch diameters are rigidly installed. The lower platen is supported on a ball bearing to allow ideal alignment with the upper platen. The three holding bolts for the lower platen are loosened, the upper platen is brought in contact with the lower platen at a load of roughly 50 pounds, and the holding bolts are then tightened to lock the lower platen into place. The extension (measured distance of the upper platen to a reference plane) should be zeroed when the upper platen is in contact with the lower platen at a load between 8 pounds and 50 pounds. The load cell should be zeroed in the free hanging state. The Instron and the load cell should be allowed to warm up for one hour before measurements are conducted.

The Instron unit is attached to a personal computer with an IEEE board for data acquisition and computer control. The computer is loaded with Instron Series XII software (1989 issue) and Version 2 firmware.

Following warm-up and zeroing of extension and the load cell, the upper platen is raised to a height of about 0.2 inches to allow sample insertion between the compression platens. Control of the Instron is then transferred to the computer.

Using the Instron Series XII Cyclic Test software (version 1.11), an instrument sequence is established. The programmed sequence is stored as a parameter file. The parameter file has 7 "markers" (discrete events) composed of three "cyclic blocks" (instructions sets) as follows:

Marker 1: Block 1
Marker 2: Block 2
Marker 3: Block 3
Marker 4: Block 2
Marker 5: Block 3
Marker 6: Block 1
Marker 7: Block 3.

Block 1 instructs the crosshead to descend at 0.75 inches per minute until a load of 0.1 pounds is applied (the Instron setting is −0.1 pounds, since compression is defined as negative force). Control is by displacement. When the targeted load is reached, the applied load is reduced to zero.

Block 2 directs that the crosshead range from an applied load of 0.05 pounds to a peak of 8 pounds then back to 0.05 pounds at a speed of 0.2 inches per minute. Using the Instron software, the control mode is displacement, the limit type is load, the first level is −0.05 pounds, the second level is −8 pounds, the dwell time is 0 seconds, and the number of transitions is 2 (compression then relaxation); "no action" is specified for the end of the block.

Block 3 uses displacement control and limit type to simply raise the crosshead to 0.15 inches at a speed of 4 inches per minute, with 0 dwell time. Other Instron software settings are 0 in first level, 0.15 inch in second level, 1 transition, and "no action" at the end of the block. If a sample has an uncompressed thickness greater than 0.15 inch, then Block 3 should be modified to raise the crosshead level to an appropriate height, and the altered level should be recorded and noted.

When executed in the order given above (Markers 1–7), the Instron sequence compresses the sample to 0.025 pounds per square inch (0.1 pound force), relaxes, then compresses to 2 psi (8 pound force), followed by decompression and a crosshead rise to 0.15 inches, then compresses the sample again to 2 psi, relaxes, lifts the crosshead to 0.15 inches, compresses again to 0.025 psi (0.1 pound force), and then raises the crosshead. Data logging should be performed at intervals no greater than every 0.004 inches or 0.03 pound force (whichever comes first) for Block 2 and for intervals no greater than 0.003 pound force for Block 1. Once the test is initiated, slightly less than two minutes elapse until the end of the Instron sequence.

The results output of the Series XII software is set to provide extension (thickness) at peak loads for Markers 1, 2, 4 and 6 (at each 0.025 and 2.0 psi peak load), the loading energy for Markers 2 and 4 (the two compressions to 2.0 psi), the ratio of the two loading energies (second 2 psi cycle/first 2 psi cycle), and the ratio of final thickness to initial thickness (ratio of thickness at last to first 0.025 psi compression). Load versus thickness results are plotted on screen during execution of Blocks 1 and 2.

Sample Preparation

Converted tissue samples are conditioned for at least 24 hours in a Tappi conditioning room (50% relative humidity at 73° F.). A length of three or four perforated sheets is unwound from the roll and folded at the perforations to form a Z- or W-folded stack. The stack is then die cut to a 2.5 inch square, with the square cut from the center of the folded stack. The mass of the cut square is then measured with a precision of 10 milligrams or better. Cut sample mass preferably should be near 0.5 gram, and should be between 0.4 and 0.6 gram; if not, the number of sheets in the stack should be adjusted. (Three or four sheets per stack proved adequate for all runs in this study; tests done with both three and four sheets did not show a significant difference in wet resiliency results).

Moisture is applied uniformly with a fine spray of deionized water at 70°–73° F. This can be achieved using a conventional plastic spray bottle, with a container or other barrier blocking most of the spray, allowing only about the outer 20 percent of the spray envelope —a fine mist—to approach the sample. If done properly, no wet spots from large droplets will appear on the sample during spraying, but the sample will become uniformly moistened. The spray source should remain at least 6 inches away from the sample during spray application. The objective is to partially saturate the sample to a moisture ratio (grams of water per gram of fiber) in the range of 0.9 to 1.6.

A flat porous support is used to hold the samples during spraying while preventing the formation of large water droplets on the supporting surface that could be imbibed into sample edges, giving wet spots. An open cell reticulated foam material was used in this study, but other materials such as an absorbent sponge could also suffice.

For a stack of three sheets, the three sheets should be separated and placed adjacent to each other on the porous support. The mist should be applied uniformly, spraying successively from two or more directions, to the separated sheets using a fixed number of sprays (pumping the spray bottle a fixed number of times), the number being determined by trial and error to obtain a targeted moisture level. The samples are quickly turned over and sprayed again with a fixed number of sprays to reduce z-direction moisture gradients in the sheets. The stack is reassembled in the original order and with the original relative orientations of the sheets. The reassembled stack is quickly weighed with a precision of at least 10 milligrams and is then centered on the lower Instron compression platen, after which the computer is used to initiate the Instron test sequence. No more than 60 seconds should elapse between the first contact of spray with the sample and the initiation of the test sequence, with 45 seconds being typical.

When four sheets per stack are needed to be in the target range, the sheets tend to be thinner than in the case of three sheet stacks and pose increased handling problems when moist. Rather than handling each of four sheets separately during moistening, the stack is split into two piles of two sheets each and the piles are placed side by side on the porous substrate. Spray is applied, as described above, to moisten the top sheets of the piles. The two piles are then turned over and approximately the same amount of moisture is applied again. Although each sheet will only be moistened from one side in this process, the possibility of z-direction moisture gradients in each sheet is partially mitigated by the generally decreased thickness of the sheets in four-sheet stacks compared to three-sheet stacks. (Limited tests with stacks of three and four sheets from the same tissue showed no significant differences, indicating that z-direction moisture gradients in the sheets, if present, are not likely to be a significant factor in compressive wet resiliency measurement). After moisture application, the stacks are reassembled, weighed and placed in the Instron device for testing, as previously described for the case of three-stack sheets.

Following the Instron test, the sample is placed in a 105° C. convection oven for drying. When the sample is fully dry (after at least 20 minutes), the dry weight is recorded. (If a heated balance is not used, the sample weight must be taken within a few seconds of removal from the oven because moisture immediately begins to be absorbed by the sample.) Data are retained for samples with moisture ratios in the range of 0.9 to 1.6. Experience has shown the values of WCB, LER and WS to be relatively constant over this range.

Output Parameters

Three measures of wet resiliency are considered. The first measure is the sample bulk at peak load on the first compression cycle to 2 psi, hereafter termed "Wet Compressive Bulk" or WCB. This bulk level is achieved dynamically and may differ from static measurements of bulk at 2 psi. The second measure is termed "Wet Springback" or WS which is the ratio of the sample thickness at 0.025 psi at the end of the test sequence to the thickness of the sample at 0.025 psi measured at the beginning of the test sequence. The third measure is the "Loading Energy Ratio" or LER, which is the ratio of loading energy in the second compression to 2 psi to the loading energy of the first such compression during a single test sequence. The loading energy is the area under the curve on a plot of applied load versus thickness for a sample going from no load to the peak load of 2 psi; loading energy has units of inches-pound force. If a material collapses after compression and loses its bulk, a subsequent compression will require much less energy, resulting in a low LER. For a purely elastic material, the springback and LER would be unity. The three measures described here are relatively independent of the number of layers in the stack and serve as useful measures of wet resiliency. Both LER and WS can be expressed as percentages.

Typical bath tissues and facial tissue materials exhibit LER values on the order of 35%–50%. Values over 50%, as shown by the uncreped throughdried bath tissue in FIG. 19, are unusually good for a wetted bulky material without permanent wet strength resin. Wet Springback for typical tissues range from 40% to 50%, with values over 50% showing good wet resiliency. Values over 60%, such as those achieved by the uncreped throughdried tissue, are extremely unusual in a bulky tissue without permanent wet strength resin. If a material is initially dense or if an initially bulky material collapses upon wetting prior to mechanical compression, the LER and the Wet Springback may be high, but the initial bulk and Wet Compressed Bulk will be low. Achieving high LER, high Wet Springback, and high Wet Compressed Bulk is only possible if a bulky structure has excellent wet resiliency. A bulky but incompressible material would also exhibit high wet resiliency, but would be far too stiff to be used for facial or bathroom tissue.

EXAMPLES

Example 1

In order to further illustrate this invention, an uncreped throughdried tissue was produced using the method substantially as illustrated in FIG. 1. More specifically, three-layered single-ply bath tissue was made in which the outer layers comprised dispersed, debonded Cenibra eucalyptus fibers and the center layer comprised refined northern softwood kraft fibers.

Prior to formation, the eucalyptus fibers were pulped for 15 minutes at 10 percent consistency and dewatered to 30 percent consistency. The pulp was then fed to a Maule shaft disperser operated at 160° F. (70° C.) with a power input of 3.2 horsepower-days per ton (2.6 kilowatt-days per tonne). Subsequent to dispersing, a softening agent (Berocell 596) was added to the pulp in the amount of 15 pounds of Berocell per tonne of dry fiber (0.75 weight percent).

The softwood fibers were pulped for 30 minutes at 4 percent consistency and diluted to 3.2 percent consistency after pulping, while the dispersed, debonded eucalyptus fibers were diluted to 2 percent consistency. The overall layered sheet weight was split 35%/30%/35% among the dispersed eucalyptus/refined softwood/dispersed eucalyptus layers. The center layer was refined to levels required to achieve target strength values, while the outer layers provided the surface softness and bulk. Parez 631NC was added to the center layer at 10–13 pounds (4.5–5.9 kilograms) per tonne of pulp based on the center layer.

A four-layer headbox was used to form the wet web with the refined northern softwood kraft stock in the two center layers of the headbox to produce a single center layer for the three-layered product described. Turbulence-generating inserts recessed about 3 inches (75 millimeters) from the slice and layer dividers extending about 6 inches (150 millimeters) beyond the slice were employed. Flexible lip extensions extending about 6 inches (150 millimeters) beyond the slice were also used, as taught in U.S. Pat. No. 5,129,988 issued Jul. 14, 1992 to Farrington, Jr. entitled "Extended Flexible headbox Slice With Parallel Flexible Lip Extensions and Extended Internal Dividers", which is herein incorporated by reference. The net slice opening was about 0.9 inch (23 millimeters) and water flows in all four headbox layers were comparable. The consistency of the stock fed to the headbox was about 0.09 weight percent.

The resulting three-layered sheet was formed on a twin-wire, suction form roll, former with forming fabrics (12 and 13 in FIG. 1) being Lindsay 2164 and Asten 866 fabrics, respectively. The speed of the forming fabrics was 11.9 meters per second. The newly-formed web was then dewatered to a consistency of about 20–27 percent using vacuum suction from below the forming fabric before being transferred to the transfer fabric, which was travelling at 9.1 meters per second (30% rush transfer). The transfer fabric was an Appleton Wire 94M. A vacuum shoe pulling about 6–15 inches (150–380 millimeters) of mercury vacuum was used to transfer the web to the transfer fabric.

The web was then transferred to a throughdrying fabric (Lindsay Wire T216-3, previously described in connection with FIG. 2 and as illustrated in FIG. 9). The throughdrying fabric was travelling at a speed of about 9.1 meters per second. The web was carried over a Honeycomb throughdryer operating at a temperature of about 350° F. (175° C.) and dried to final dryness of about 94–98 percent consistency. The resulting uncreped tissue sheet was then calendered at a fixed gap of 0.040 inch (0.10 centimeter) between a 20 inch (51 centimeters) diameter steel roll and a 20.5 inch (52.1 centimeters) diameter, 110 P&J Hardness rubber covered roll. The thickness of the rubber cover was 0.725 inch (1.84 centimeters).

The resulting calendered tissue sheet had the following properties: Basis Weight, 16.98 pounds per 2880 square feet; CD Stretch, 8.6 percent; Bulk, 13.18 cubic centimeters per gram; Geometric Mean Modulus divided by Geometric Mean Tensile, 3.86 kilometers per kilogram; Absorbent Capacity, 11.01 grams water per gram fiber; MD Stiffness, 68.5 kilogram-microns$^{1/2}$; MD Tensile Strength, 714 grams per 3 inches sample width; and CD Tensile Strength, 460 grams per 3 inches sample width.

Example 2

Uncreped throughdried bath tissue was made as described in Example 1, except the throughdrying fabric was replaced with a Lindsay Wire T116-3 as described in connection with FIG. 2.

The resulting sheet had the following properties: Basis Weight, 17.99 pounds per 2880 square feet; CD Stretch, 8.5 percent; Bulk, 17.57 cubic centimeters per gram; Geometric Mean Modulus divided by Geometric Mean Tensile, 3.15 kilometers per kilogram; Absorbent Capacity, 11.29 grams water per gram fiber; MD Stiffness, 89.6 kilogram-microns$^{1/2}$; MD Tensile Strength, 753 grams per 3 inches sample width; and CD Tensile Strength, 545 grams per 3 inches sample width.

Example 3

A single-ply uncreped throughdried bath tissue was made as described in Example 1, except the tissue had a 25/75 eucalyptus/softwood ratio. The softwood layer was refined to achieve the desired strength level. Kymene 557LX was added to the entire furnish at a level of 25 pounds per tonne.

The final product had the following properties: Basis Weight, 13.55 pounds per 2880 square feet; CD Stretch, 20.1 percent; Bulk, 24.89 cubic centimeters per gram; MD Stiffness, 74.5 kilogram-microns$^{1/2}$; Geometric Mean Modulus divided by Geometric Mean Tensile, 3.13 kilometers per kilogram; MD Tensile Strength, 777 grams per 3 inches sample width; and CD Tensile Strength, 275 grams per 3 inches sample width.

Example 4

A single-ply uncreped throughdried bath tissue was made as described in Example 2, but was left uncalendered. The resulting sheet had the following properties: Basis Weight, 17.94; CD Stretch, 13.2 percent; Bulk, 22.80 cubic centimeters per gram; MD Stiffness, 120.1 kilogram-microns$^{1/2}$; Geometric Mean Modulus divided by the Geometric Mean Tensile, 3.35 kilometers per kilogram; Absorbent Capacity, 12.96; MD Tensile Strength, 951 grams per 3 inches sample width; and CD Tensile Strength, 751 grams per 3 inches sample width.

Example 5

In order to further illustrate this invention, a single-ply, uncreped, throughdried towel was made using the method substantially as illustrated in FIG. 1, but using a different former. More specifically, prior to formation, a raw materials mix of 13% white and colored ledger, 37.5% sorted office waste, 19.5% manifold white ledger and 30% coated white sulfite was commercially deinked using flotation and washing steps. Prior to forming the sheet, Kymene 557LX and QuaSoft 206 were mixed with the fiber slurry at a rate of 11 pounds per tonne and 3.5 pounds per tonne, respectively.

A single channel headbox was used to form a wet web on a flat fourdrinier table with the forming fabric being a Lindsay Wire Pro 57B (fabric 13 in FIG. 1). The speed of the former was 6.0 meters per second. The newly-formed web was then dewatered to a consistency of about 20–27 percent using vacuum suction from below the forming fabric before being transferred to the transfer fabric, which was travelling at 5.5 meters per second (8% rush transfer). The transfer fabric was an Asten 920. A vacuum shoe pulling about 6–15 inches (150–380 millimeters) of mercury vacuum was used to transfer the web to the transfer fabric.

The web was transferred to a throughdryer fabric (Lindsay Wire T-34) as illustrated in FIG. 10 having a mesh count of 72 by 32, a MD strand diameter of 0.013 inch (paired warps), and a CD strand diameter of 0.014 inch, with every fifth CD strand having a diameter of 0.02 inch. The fabric had a plane difference of about 0.012 inch and there were 10 impression knuckles per lineal inch in the cross-machine direction and about 45 impression knuckles per square inch. The throughdrying fabric was travelling at a speed of about 5.5 meters per second. The web was carried over a Honeycomb throughdryer operating at a temperature of about 350° F. (175° C.) and dried to final dryness of about 94–98 percent consistency.

The uncreped tissue sheet was then calendered between two 20 inch steel rolls loaded to about 12–20 pounds per lineal inch. The resulting sheet had the following properties: Basis Weight, 39.8 grams per square meter; CD Stretch, 9.1 percent; Bulk, 11.72 cubic centimeters per gram; and Wicking Rate, 2.94 centimeters per 15 seconds.

Example 6

A single ply throughdried bathroom tissue was made similarly to that of Example 1 except for the following changes: Lindsay T-124-1 throughdrying fabric; Varisoft 3690PG90 (from Witco Corporation) replaced Berocell 596 as the softening agent; approximately 35% rush transfer. The sheet had four layers of 27%/16%/30%/27% according to the following scheme: dispersed eucalyptus/dispersed eucalyptus/northern softwood kraft/dispersed eucalyptus (throughdrying fabric side). The sheet was reel calendered with steel on rubber (110P&J) calender rolls to give the final product.

The final product had the following properties: Basis Weight, 24.1 pounds per 2880 square feet; CD stretch, 4.9 percent; Bulk, 8.9 cc/gm.; Geometric Mean Modulus divided by Geometric Mean Tensile, 4.04; Absorbent Capacity, 8.94 gram water per gram fiber; MD Tensile, 731 grams per 3 inch width; CD Tensile, 493 grams per 3 inch width; MD Stiffness, 106 kilogram-microns$^{1/2}$.

Example 7

A two-ply uncreped throughdried bathroom tissue was made similarly to that of Example 1 except for the following changes: Lindsay T-124-1 throughdrying fabric; Varisoft 3690PG90 (from Witco Corporation) replaced Berocell 596 as the softening agent; approximately 35% rush transfer. The sheet had three layers of 40%/40%/20% according to the following scheme: dispersed eucalyptus/northern softwood kraft/northern softwood kraft (throughdrying fabric side). The sheet was reel calendered with steel on rubber (110P&J) calender rolls to give the final product.

The final product had the following properties: Basis Weight, 23.5 pounds per 2880 square feet; CD stretch, 6.8 percent; Bulk, 8.5 cc./gm.; Geometric Mean Modulus divided by Geometric Mean Tensile, 3.64; Absorbent Capacity, 11.1 gram water per gram fiber; MD Tensile, 678 grams per 3 inch width; CD Tensile, 541 grams per 3 inch width; MD Stiffness, 70.4 kilogram-microns$^{1/2}$.

Example 8

A two-ply uncreped throughdried facial tissue was made similarly to that of Example 1 except for the following change. Lindsay T-216-4 throughdrying fabric was utilized. Each ply was split 40%/40%/20% among three layers denoted A/B/C with layers B and C being blends of northern hardwood, northern softwood and eucalyptus and layer A being pure dispersed eucalyptus. On an overall basis, the sheet is 40% dispersed eucalyptus, 10% eucalyptus, 15% northern hardwood and 35% northern softwood. Layers B&C included 5 kg/tonne Parez-631NC and 2 kg/tonne Kymene 557LX. Layer A, which was the side placed on the throughdrying fabric, included 7.5 kg/tonne Tegopren-6920 (from Goldschmidt Chemical Company) and 7.5 kg/tonne Kymene 557LX. The sheet was reel calendered with steel on rubber (50P&J) calender rolls to give the final plies. These were plied together with the dispersed eucalyptus sides out and calendered twice (once steel on steel at 50 pli and once steel on rubber at 30 pli) to reduce caliper.

The final product had the following properties: Basis Weight, 23.0 pounds per 2880 square feet; CD stretch, 7.3 percent; Bulk, 7.49 cc/gm; Geometric Mean Modulus divided by Geometric Mean Tensile, 3.45; Absorbent Capacity, 12.0 gram water per gram fiber; MD Tensile, 915 grams per 3 inch width; CD Tensile, 725 grams per 3 inch width; MD Stiffness, 79.5 kilogram-microns$^{1/2}$.

Example 9

A two-ply uncreped throughdried facial tissue was made similarly to that of Example 8 except that the resulting plies were plied together with the dispersed eucalyptus sides out and calendered again (steel on steel at 50 pli) to reduce caliper.

The final product had the following properties: Basis Weight, 19.3 pounds per 2880 square feet; CD stretch, 7.5 percent; Bulk, 8.93 cc/gm; Geometric Mean Modulus divided by Geometric Mean Tensile, 3.99; Absorbent Capacity, 13.5 gram water per gram fiber; MD Tensile, 867 grams per 3 inch width; CD Tensile, 706 grams per 3 inch width; MD Stiffness, 75.6 kilogram-microns$^{1/2}$.

Example 10

In order to illustrate the superior wet integrity of this invention, an uncreped throughdried tissue was produced using the method substantially as illustrated in FIG. 1. More specifically, three-layered single-ply bath tissue was made in which the outer layers comprised dispersed, debonded Cenibra eucalyptus fibers and the center layer comprised refined northern softwood kraft fibers.

Prior to formation, the eucalyptus fibers were pulped for 15 minutes at 10 percent consistency and dewatered to 30 percent consistency. The pulp was then fed to a Maule shaft disperser operated at 160° F. (70° C.) with a power input of 3.2 horsepower-days per ton (2.6 kilowatt-days per tonne). Subsequent to dispersing, a softening agent (Varisoft 3690PG90) was added to the pulp in the amount of 7.0 kilograms of debonder per tonne of dispersed dry fiber.

The softwood fibers were pulped for 30 minutes at 4 percent consistency and diluted to 3.2 percent consistency after pulping, while the dispersed, debonded eucalyptus fibers were diluted to 2 percent consistency. The overall layered sheet weight was split 27%/46%/27% among the dispersed eucalyptus/refined softwood/dispersed eucalyptus layers. The center layer was refined to levels required to achieve target strength values, while the outer layers provided the surface softness and bulk. Parez 631NC was added to the center layer at 4.0 kilograms per tonne of pulp based on the center layer.

A four-layer headbox was used to form the wet web with the refined northern softwood kraft stock in the two center layers of the headbox to produce a single center layer for the three-layered product described. Turbulence-generating inserts recessed about 3 inches (75 millimeters) from the slice and layer dividers extending about 6 inches (150 millimeters) beyond the slice were employed. The net slice opening was about 0.9 inch (23 millimeters) and water flows in all four headbox layers were comparable. The consistency of the stock fed to the headbox was about 0.09 weight percent.

The resulting three-layered sheet was formed on a twin-wire, suction form roll, former with forming fabrics being Lindsay 2164 and Asten 866 fabrics, respectively. The speed of the forming fabrics was about 12 meters per second. The newly-formed web was then dewatered to a consistency of about 20–27 percent using vacuum suction from below the forming fabric before being transferred to the transfer fabric, which was traveling at 9.1 meters per second (30% rush transfer). The transfer fabric was an Appleton Wire 94M. A vacuum shoe pulling about 6–15 inches (150–380 millimeters) of mercury vacuum was used to transfer the web to the transfer fabric.

The web was then transferred to a three-dimensional throughdrying fabric (Lindsay Wire T-124-1) as described herein. The throughdrying fabric was traveling at a speed of about 9.1 meters per second. The web was carried over a Honeycomb throughdryer operating at a temperature of about 350° F.(175° C.) and dried to final dryness of about 94–98 percent consistency. The resulting uncreped tissue sheet was then calendered at a fixed gap of 0.040 inch (0.10 centimeter) between a 20 inch (51 centimeters) diameter steel roll and a 20.5 inch (52.1 centimeters) diameter, 110 P&J Hardness rubber covered roll. The thickness of the rubber cover was 0.725 inch (1.84 centimeters).

The resulting uncreped throughdried sheet had the following properties: Basis Weight; 20.8 lbs/2880 sq. ft., MD Tensile, 713 gm/3"; MD Stretch, 17.2%; CD Tensile, 527 gm/3"; CD Stretch, 4.9%; WCB, 5.6 cc/gm; LER, 55.6%; WS, 62.9%.

Example 11

An uncreped throughdried tissue was produced using the method substantially as described in Example 10 except that the basis weight was targeted for 24 lbs/2880 sq. ft.

The resulting uncreped throughdried sheet had the following properties: Basis Weight; 24.1 lbs/2880 sq. ft., MD Tensile, 731 gm/3"; MD Stretch, 17.1%; CD Tensile, 493 gm/3; CD Stretch, 4.9%; WCB, 5.3 cc/gm; LER, 55.8%; WS, 64.4%.

Example 12

An uncreped throughdried tissue was produced using the method substantially as described in Example 10 except that the dispersed, debonded eucalyptus was replaced with dispersed, debonded southern hardwood. The resulting uncreped throughdried sheet had the following properties: Basis Weight; 20.3 lbs/2880 sq. ft., MD Tensile, 747 gm/3"; MD Stretch, 17.5%; CD Tensile, 507 gm/3"; CD Stretch, 5.5%; WCB, 5.4 cc/gm; LER, 53.6%; WS, 60.8%.

Example 13

An uncreped throughdried tissue was produced using the method substantially as described in Example 10 except that: the basis weight was targeted for 18 lbs/2880 sq.ft.; A Lindsay T-216-3A throughdrying fabric was employed and Berocell 596 was used for the debonder. The sheet was further calendered in converting. The resulting uncreped throughdried sheet had the following properties: Basis Weight; 17.5 lbs/2880 sq. ft., MD Tensile, 1139 gm/3"; MD Stretch, 21.2%; CD Tensile, 1062 gm/3"; CD Stretch, 6.8%; WCB, 5.23 cc/gm; LER, 53.4%; WS, 64.2%

It will be appreciated that the foregoing examples, given for purposes of illustration, are not to be construed as limiting the scope of this invention, which is defined by the following claims and all equivalents thereto.

We claim:

1. A method of making a tissue sheet comprising:

(a) depositing an aqueous suspension of papermaking fibers having a consistency of about 1 percent or less onto a forming fabric to form a wet web;

(b) dewatering the wet web to a consistency of from about 20 to about 30 percent;

(c) transferring the dewatered web from the forming fabric to a transfer fabric traveling at a speed of from about 10 to about 80 percent slower than the forming fabric (d) transferring the web to a throughdrying fabric having from about 5 to about 300 elongated machine direction knuckles per square inch which are raised at least about 0.005 inch above the plane formed by the highest points of the cross-machine direction knuckles of the fabric, wherein the web is macroscopically rearranged to conform to the surface of the throughdrying fabric; and (e) throughdrying the web to produce a throughdried web of substantially uniform density having a Wet Compressed Bulk (WCB) of about 4.5 or greater, an Absorbent Capacity of about 9 grams per gram or greater and a cross-machine direction stretch of about 9 percent or greater.

2. A method of making a tissue sheet comprising:

(a) depositing an aqueous suspension of papermaking fibers having a consistency of about 1 percent or less onto a forming fabric to form a wet web;

(b) dewatering the wet web to a consistency of from about 20 to about 30 percent;

(c) transferring the dewatered web from the forming fabric to a transfer fabric traveling at a speed of from about 10 to about 80 percent slower than the forming fabric;

(d) transferring the web to a throughdrying fabric having from about 5 to about 300 elongated machine direction knuckles per square inch which are raised at least about 0.005 inch above the plane formed by the highest points of the cross-machine direction knuckles of the fabric, wherein the web is macroscopically rearranged to conform to the surface of the throughdrying fabric; and (e) throughdrying the web to produce a throughdried web of substantially uniform density having a Wet Springback (WS) of about 50 percent or greater, an Absorbent Capacity of about 9 grams per gram or greater and a cross-machine direction stretch of about 9 percent or greater.

3. A method of making a tissue sheet comprising:

(a) depositing an aqueous suspension of papermaking fibers having a consistency of about 1 percent or less onto a forming fabric to form a wet web;

(b) dewatering the wet web to a consistency of from about 20 to about 30 percent;

(c) transferring the dewatered web from the forming fabric to a transfer fabric traveling at a speed of from about 10 to about 80 percent slower than the forming fabric;

(d) transferring the web to a throughdrying fabric having from about 5 to about 300 elongated machine direction knuckles per square inch which are raised at least about 0.005 inch above the plane formed by the highest points of the cross-machine direction knuckles of the fabric, wherein the web is macroscopically rearranged to conform to the surface of the throughdrying fabric; and (e) throughdrying the web to produce a throughdried web of substantially uniform density having a Loading Energy Ratio (LER) of about 50 percent or greater, an Absorbent Capacity of about 9 grams per gram or greater and a cross-machine direction stretch of about 9 percent or greater.

4. The method of claim 1, 2 or 3 wherein the number of elongated machine direction knuckles is from about 10 to about 150 per square inch.

5. The method of claim 1, 2 or 3 wherein the number of elongated machine direction knuckles is from about 10 to about 75 per square inch.

6. The method of claim 1, 2 or 3 wherein the transfer fabric has from about 5 to about 300 elongated machine direction knuckles per square inch which are raised about 0.005 inch or greater above the plane formed by the highest points of the cross-machine direction knuckles of the transfer fabric.

7. The method of claim 6 wherein the number of elongated machine direction knuckles in the transfer fabric is from about 10 to about 150 per square inch.

8. The method of claim 6 wherein the number of elongated machine direction knuckles in the transfer fabric is from about 10 to about 75 per square inch.

9. The method of claim 1, 2 or 3 wherein the throughdried web is calendered.

10. The method of claim 1, 2 or 3 wherein the throughdried web is creped.

11. The method of claim 1, 2 or 3 wherein the throughdried web is uncreped.

12. A method of making a tissue sheet comprising:

(a) depositing an aqueous suspension of papermaking fibers having a consistency of about 1 percent or less onto a forming fabric—to form a wet web;

(b) dewatering the wet web to a consistency of from about 20 to 30 percent;

(c) transferring the dewatered web from the forming fabric to a transfer fabric traveling at a speed of from about 10 to about 80 percent slower than the forming fabric said transfer fabric having from about 5 to about 300 elongated machine direction knuckles per square inch which are raised at least about 0.005 inch above the plane formed by the highest points of the cross-machine direction knuckles of the transfer fabric, wherein the web is macroscopically rearranged to conform to the surface of the transfer fabric; and (d) transferring the web to a throughdrying fabric and drying the web to produce a web of substantially uniform density having a Wet Compressed Bulk (WCB) of about 4.5 or greater, an Absorbent Capacity of about 9 grams per gram or greater and a cross-machine direction stretch of about 9 percent or greater.

13. A method of making a tissue sheet comprising:

(a) depositing an aqueous suspension of papermaking fibers having a consistency of about 1 percent or less onto a forming fabric to form a wet web;

(b) dewatering the wet web to a consistency of from about 20 to 30 percent;

(c) transferring the dewatered web from the forming fabric to a transfer fabric traveling at a speed of from about 10 to about 80 percent slower than the forming fabric, said transfer fabric having from about 5 to about 300 elongated machine direction knuckles per square inch which are raised at least about 0.005 inch above the plane formed by the highest points of the cross-machine direction knuckles of the transfer fabric, wherein the web is macroscopically rearranged to conform to the surface of the transfer fabric; and (d) transferring the web to a throughdrying fabric and drying the web to produce a web of substantially uniform density having a Wet Springback (WS) of about 50 percent or greater, an Absorbent Capacity of about 9 grams per gram or greater and a cross-machine direction stretch of about 9 percent or greater.

14. A method of making a tissue sheet comprising:

(a) depositing an aqueous suspension of papermaking fibers having a consistency of about 1 percent or less onto a forming fabric to form a wet web;

(b) dewatering the wet web to a consistency of from about 20 to 30 percent;

(c) transferring the dewatered web from the forming fabric to a transfer fabric traveling at a speed of from about 10 to about 80 percent slower than the forming fabric, said transfer fabric having from about 5 to about 300 elongated machine direction knuckles per square inch which are raised at least about 0.005 inch above the plane formed by the highest points of the cross-machine direction knuckles of the transfer fabric, wherein the web is macroscopically rearranged to conform to the surface of the transfer fabric; and (d) transferring the web to a throughdrying fabric and drying the web to produce a web of substantially uniform density having a Loading Energy Ratio (LER) of about 50 percent or greater, an Absorbent Capacity of about 9 grams per gram or greater and a cross-machine direction stretch of about 9 percent or greater.

15. The method of claim 12, 13 or 14 wherein the number of elongated machine direction knuckles is from about 10 to about 150 per square inch.

16. The method of claim 12, 13 or 14 wherein the number of elongated machine direction knuckles is from about 10 to about 75 per square inch.

17. A method of making a soft uncreped throughdried tissue product comprising:

(a) forming an aqueous suspension of papermaking fibers having a consistency of about 20 percent or greater;

(b) mechanically working the aqueous suspension at a temperature of about 140° F. or greater provided by an external heat source with a power input of about 1 horsepower per day per ton of dry fiber or greater;

(c) diluting the aqueous suspension of mechanically worked fibers to a consistency of about 0.5 percent or less and feeding the diluted suspension to a layered tissuemaking headbox providing two or more layers;

(d) including a temporary or permanent wet strength additive in one or more of said layers;

(e) depositing the diluted aqueous suspension onto a forming fabric to form a wet web;

(f) dewatering the wet web to a consistency of from about 20 to about 30 percent;

(g) transferring the dewatered web from the forming fabric to a transfer fabric traveling at a speed of from about 10 to about 80 percent slower than the forming fabric;

(h) transferring the web to a throughdrying fabric having from about 5 to about 300 elongated machine direction knuckles per square inch which are raised at least about 0.005 inch above the plane formed by the highest points of the cross-machine direction knuckles of the throughdrying fabric whereby the web is macroscopically rearranged to conform to the surface of the throughdrying fabric;

(i) throughdrying the web to final dryness with a substantially uniform density and having a Wet Compressed Bulk (WCB) of about 4.5 or greater, an Absorbent Capacity of about 9 grams per gram or greater and a cross-machine direction stretch of about 9 percent or greater; and (j) calendering the dried web.

18. A method of making a soft uncreped throughdried tissue product comprising:

(a) forming an aqueous suspension of papermaking fibers having a consistency of about 20 percent or greater;

(b) mechanically working the aqueous suspension at a temperature of about 140° F. or greater provided by an external heat source with a power input of about 1 horsepower per day per ton of dry fiber or greater;

(c) diluting the aqueous suspension of mechanically worked fibers to a consistency of about 0.5 percent or less and feeding the diluted suspension to a layered tissuemaking headbox providing two or more layers;

(d) including a temporary or permanent wet strength additive in one or more of said layers;

(e) depositing the diluted aqueous suspension onto a forming fabric to form a wet web;

(f) dewatering the wet web to a consistency of from about 20 to about 30 percent;

(g) transferring the dewatered web from the forming fabric to a transfer fabric traveling at a speed of from about 10 to about 80 percent slower than the forming fabric;

(h) transferring the web to a throughdrying fabric having from about 5 to about 300 elongated machine direction knuckles per square inch which are raised at least about 0.005 inch above the plane formed by the highest points of the cross-machine direction knuckles of the throughdrying fabric whereby the web is macroscopically rearranged to conform to the surface of the throughdrying fabric;

(i) throughdrying the web to final dryness with a substantially uniform density and having a Wet Springback (WS) of about 50 percent or greater, an Absorbent Capacity of about 9 grams per gram or greater and a cross-machine direction stretch of about 9 percent or greater; and (j) calendering the dried web.

19. A method of making a soft uncreped throughdried tissue product comprising:

(a) forming an aqueous suspension of papermaking fibers having a consistency of about 20 percent or greater;

(b) mechanically working the aqueous suspension at a temperature of about 140° F. or greater provided by an external heat source with a power input of about 1 horsepower per day per ton of dry fiber or greater;

(c) diluting the aqueous suspension of mechanically worked fibers to a consistency of about 0.5 percent or less and feeding the diluted suspension to a layered tissuemaking headbox providing two or more layers;

(d) including a temporary or permanent wet strength additive in one or more of said layers;

(e) depositing the diluted aqueous suspension onto a forming fabric to form a wet web;

(f) dewatering the wet web to a consistency of from about 20 to about 30 percent;

(g) transferring the dewatered web from the forming fabric to a transfer fabric traveling at a speed of from about 10 to about 80 percent slower than the forming fabric;

(h) transferring the web to a throughdrying fabric having from about 5 to about 300 elongated machine direction knuckles per square inch which are raised at least about 0.005 inch above the plane formed by the highest points of the cross-machine direction knuckles of the throughdrying fabric whereby the web is macroscopically rearranged to conform to the surface of the throughdrying fabric;

(i) throughdrying the web to final dryness with a substantially Uniform density and having a Loading Energy Ratio (LER) of about 50 percent or greater, an Absorbent Capacity of about 9 grams per gram or greater and a cross-machine direction stretch of about 9 percent or greater; and (j) calendering the dried web.

20. The method of claim 1, 2, 3, 12, 13, 14, 17, 18 or 19 wherein the length of the machine direction knuckles is from about 0.030 inch to about 0.425 inch.

21. The method of claim 1, 2, 3, 12, 13, 14, 17, 18 or 19 wherein the length of the machine direction knuckles is from about 0.05 inch to about 0.25 inch.

22. The method of claim 1, 2, 3, 12, 13, 14, 17, 18 or 19 wherein the length of the machine direction knuckles is from about 0.1 inch to about 0.2 inch.

23. The method of claim 1, 2, 3, 12, 13, 14, 17, 18 or 19 wherein the machine direction knuckles cross over from about 2 to about 15 shute strands.

24. The method of claim 1, 2, 3, 12, 13, 14, 17, 18 or 19 wherein the machine direction knuckles cross over from about 3 to about 11 shute strands.

25. The method of claim 1, 2, 3, 12, 13, 14, 17, 18 or 19 wherein the machine direction knuckles cross over from about 3 to about 7 shute strands.

26. The method of claim 1, 2, 3, 12, 13, 14, 17, 18 or 19 wherein the machine direction knuckles appear to overlap when viewed in the cross-machine direction.

27. The method of claim 1, 2, 3, 12, 13, 14, 17, 18 or 19 wherein the height of the elongated machine direction knuckles, as measured by the plane difference between the plane formed by the highest points of the elongated machine direction knuckles and the plane formed by the highest points of the shute knuckles, is from about 30 to about 150 percent of the diameter of the warp strands that form the elongated machine direction knuckles.

28. The method of claim 1, 2, 3, 12, 13, 14, 17, 18 or 19 wherein the height of the elongated machine direction knuckles, as measured by the plane difference between the plane formed by the highest points of the elongated machine direction knuckles and the plane formed by the highest points of the shute knuckles, is from about 70 to about 110 percent of the diameter of the warp strands that form the elongated machine direction knuckles.

29. A method of making a tissue sheet comprising:

(a) depositing an aqueous suspension of papermaking fibers having a consistency of about 1 percent or less onto a forming fabric to form a wet web;

(b) dewatering the wet web to a consistency of from about 20 to about 30 percent;

(c) transferring the dewatered web from the forming fabric to a transfer fabric traveling at a speed of from about 10 to about 80 percent slower than the forming fabric;

(d) transferring the web to a throughdrying fabric having a load-bearing layer and a three-dimensional sculpture layer, said sculpture layer having from about 5 to about 300 elongated machine direction knuckles per square inch which are formed by impression strand segments woven into the fabric in the machine direction of the fabric, wherein the plane difference between the plane formed by the top surface of the load-bearing layer and the plane formed by the tops of the elongated machine direction knuckles in the sculpture layer is at least 30 percent of the impression strand diameter, and wherein the web is macroscopically rearranged to conform to the surface of the throughdrying fabric; and (e) throughdrying the web such that the web has a substantially uniform density and a Wet Compressed Bulk of about 4.5 or greater, an Absorbent Capacity of about 9 grams per gram or greater and a cross-machine direction stretch of about 9 percent or greater.

30. A method of making a tissue sheet comprising:

(a) depositing an aqueous suspension of papermaking fibers having a consistency of about 1 percent or less onto a forming fabric to form a wet web;

(b) dewatering the wet web to a consistency of from about 20 to about 30 percent;

(c) transferring the dewatered web from the forming fabric to a transfer fabric traveling at a speed of from about 10 to about 80 percent slower than the forming fabric;

(d) transferring the web to a throughdrying fabric having a load-bearing layer and a three-dimensional sculpture layer, said sculpture layer having from about 5 to about 300 elongated machine direction knuckles per square inch which are formed by impression strand segments woven into the fabric in the machine direction of the fabric, wherein the plane difference between the plane formed by the top surface of the load-bearing layer and the plane formed by the tops of the elongated machine direction knuckles in the sculpture layer is at least 30 percent of the impression strand diameter, and wherein the web is macroscopically rearranged to conform to the surface of the throughdrying fabric; and (e) throughdrying the web such that the web has a substantially uniform density and a Wet Springback (WS) of about 50 percent or greater, an Absorbent Capacity of about 9 grams per gram or greater and a cross-machine direction stretch of about 9 percent or greater.

31. A method of making a tissue sheet comprising:

(a) depositing an aqueous suspension of papermaking fibers having a consistency of about 1 percent or less onto a forming fabric to form a wet web;

(b) dewatering the wet web to a consistency of from about 20 to about 30 percent;

(c) transferring the dewatered web from the forming fabric to a transfer fabric traveling at a speed of from about 10 to about 80 percent slower than the forming fabric (d) transferring the web to a throughdrying fabric having a load-bearing layer and a three dimensional sculpture layer, said sculpture layer having from about 5 to about 300 elongated machine direction knuckles per square inch which are formed by impression strand segments woven into the fabric in the machine direction of the fabric, wherein the plane difference between the plane formed by the top surface of the load-bearing layer and the plane formed by the tops of the elongated machine direction knuckles in the sculpture layer is at least 30 percent of the impression strand diameter, and wherein the web is macroscopically rearranged to conform to the surface of the throughdrying fabric; and (e) throughdrying the web such that the web has a substantially uniform density and a Loading Energy Ratio of about 50 percent or greater, an Absorbent Capacity of about 9 grams per gram or greater and a cross-machine direction stretch of about 9 percent or greater.

32. The method of claim 29, 30 or 31 wherein the plane difference is from 30 to 150 percent of the impression strand diameter.

33. The method of claim 29, 30 or 31 where in the plane difference is from about 70 to about 100 percent of the impression strand diameter.

34. The method of claim 29, 30 or 31 wherein the plane difference is about 90 percent of the impression strand diameter.

35. The method of claim 29, 30 or 31 wherein the impression strand diameter is from 0.005 inch to about 0.05 inch.

36. The method of claim 29, 30 or 31 wherein the number of elongated machine direction knuckles is from about 10 to about 150 per square inch.

37. The method of claim 29, 30 or 31 wherein the number of elongated machine direction knuckles is from about 10 to about 75 per square inch.

38. The method of claim 29, 30 or 31 wherein the transfer fabric has a load-bearing layer and a three-dimensional sculpture layer, said sculpture layer having from about 5 to about 300 elongated machine direction knuckles per square inch which are formed by impression strand segments woven into the transfer fabric in the machine direction of the fabric, wherein the plane difference between the plane formed by the top surface of the load-bearing layer and the plane formed by the tops of the elongated machine direction knuckles in the sculpture layer is at least 30 percent of the impression strand diameter.

39. The method of claim 29, 30 or 31 wherein the number of elongated machine direction knuckles in the transfer fabric is from about 10 to about 150 per square inch.

40. The method of claim 29, 30 or 31 wherein the number of elongated machine direction knuckles in the transfer fabric Is from about 10 to about 75 per square inch.

* * * * *